US012733746B2

(12) United States Patent
Wittekind et al.

(10) Patent No.: US 12,733,746 B2
(45) Date of Patent: Sep. 15, 2026

(54) ADJUSTABLE SUPPORT DEVICE

(71) Applicants: William Mitchell Wittekind, Salt Lake City, UT (US); Stela Angelova Markova, Salt Lake City, UT (US)

(72) Inventors: William Mitchell Wittekind, Salt Lake City, UT (US); Stela Angelova Markova, Salt Lake City, UT (US)

(73) Assignee: SIT UP, LLC, Salt Lake City, UT (US)

( * ) Notice: Subject to any disclaimer, the term of this patent is extended or adjusted under 35 U.S.C. 154(b) by 200 days.

(21) Appl. No.: 18/399,585

(22) Filed: Dec. 28, 2023

(65) Prior Publication Data

US 2024/0215731 A1 Jul. 4, 2024

Related U.S. Application Data

(60) Provisional application No. 63/436,375, filed on Dec. 30, 2022.

(51) Int. Cl.
*A47C 20/04* (2006.01)
*A47C 20/02* (2006.01)

(52) U.S. Cl.
CPC ..... *A47C 20/048* (2013.01); *A47C 20/027* (2013.01)

(58) Field of Classification Search
CPC ..... A47C 20/048; A47C 20/027; A47C 27/02; A47C 27/04
See application file for complete search history.

(56) References Cited

U.S. PATENT DOCUMENTS 3,392,412 A * 7/1968 Aymar ..... A47C 20/048 5/660
3,667,075 A * 6/1972 Ballard ..... A47C 20/048 5/660
3,781,928 A * 1/1974 Swallert ..... A47C 20/048 5/660
3,931,653 A 1/1976 Bien
3,949,435 A * 4/1976 Dionne ..... A61G 7/065 5/630
3,981,031 A 9/1976 Schacht
5,311,625 A * 5/1994 Barker ..... A47C 31/008 417/363
5,345,630 A 9/1994 Healy
5,425,150 A * 6/1995 Palmer, Jr. ..... A47C 20/048 5/634
5,528,783 A 6/1996 Kunz et al.
5,806,115 A 9/1998 Brown
(Continued)

FOREIGN PATENT DOCUMENTS

GB 2102282 A * 2/1983 ..... A47C 20/048

*Primary Examiner* — Fredrick C Conley

(57) ABSTRACT

A support device includes a frame, a frame attachment structure, and an inflatable bladder. The frame includes a first substantially planar structure and a second substantially planar structure. The first substantially planar structure is rotatably coupled to the second substantially planar structure. The frame attachment structure is configured to be removably attached to the frame. The inflatable bladder includes walls forming an interior volume and a first bladder attachment structure attached to at least one of the walls. The first bladder attachment structure forms a channel. The frame attachment structure is configured to be routed through the channel to secure the inflatable bladder to the frame.

20 Claims, 17 Drawing Sheets

(56) References Cited

U.S. PATENT DOCUMENTS

| | | | | |
|---|---|---|---|---|
| 6,139,567 | A | 10/2000 | McCarty et al. | |
| 6,438,777 | B1 | 8/2002 | Bender | |
| 6,804,846 | B2 | 10/2004 | Schuerch | |
| 6,886,204 | B2 | 5/2005 | Kasatshko et al. | |
| 7,231,681 | B2 | 6/2007 | Kasatshko et al. | |
| 7,275,273 | B2 | 10/2007 | Lary et al. | |
| 7,380,301 | B2 | 6/2008 | Chung | |
| 7,475,441 | B1 | 1/2009 | Soberal | |
| 8,146,190 | B1 | 4/2012 | Wolfe | |
| 8,914,926 | B2 | 12/2014 | Berhanu | |
| 2002/0180249 | A1* | 12/2002 | Felton | A47C 7/14 297/284.6 |
| 2003/0188386 | A1* | 10/2003 | Leventhal | A47C 20/048 5/660 |
| 2003/0196270 | A1 | 10/2003 | Leventhal et al. | |
| 2005/0155154 | A1 | 7/2005 | Kasatshko et al. | |
| 2005/0193492 | A1 | 9/2005 | Yoshino | |
| 2005/0251918 | A1 | 11/2005 | Lary et al. | |
| 2008/0066236 | A1 | 3/2008 | Hernadez | |
| 2008/0168604 | A1 | 7/2008 | Cheng | |
| 2010/0242178 | A1 | 9/2010 | Goetting | |
| 2011/0271452 | A1 | 11/2011 | Basilone | |
| 2012/0023669 | A1 | 2/2012 | Graller et al. | |
| 2015/0282630 | A1 | 10/2015 | McIntyre | |
| 2020/0100597 | A1* | 4/2020 | Ribble | A61G 7/05 |

* cited by examiner

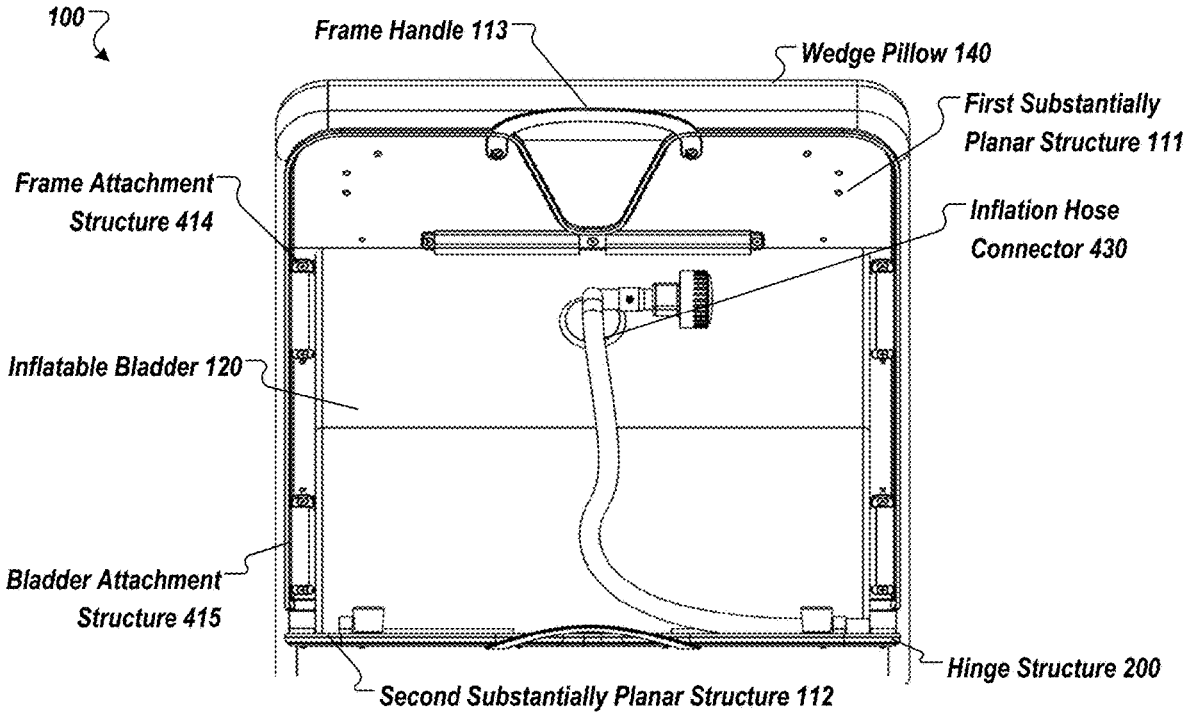
FIG. 6A.1
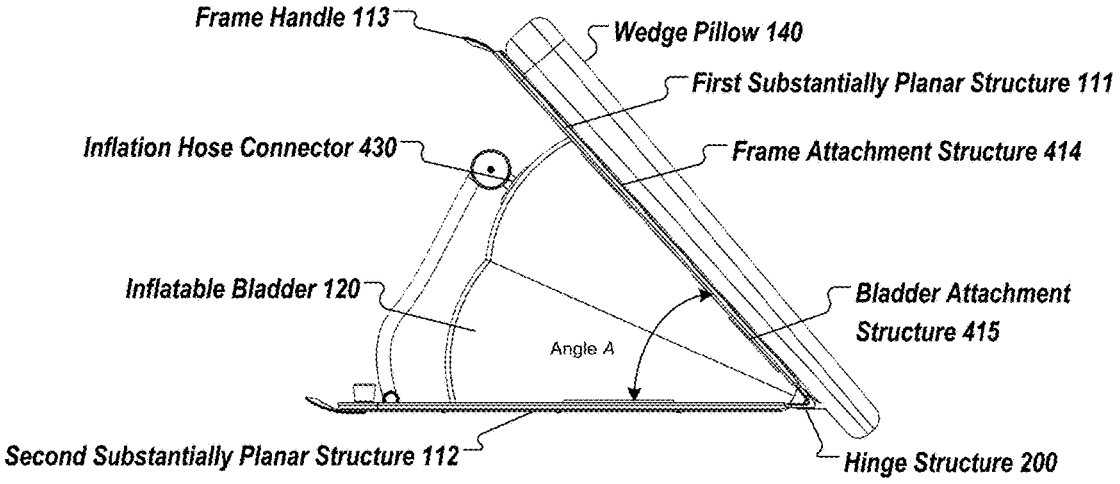
FIG. 6A.2

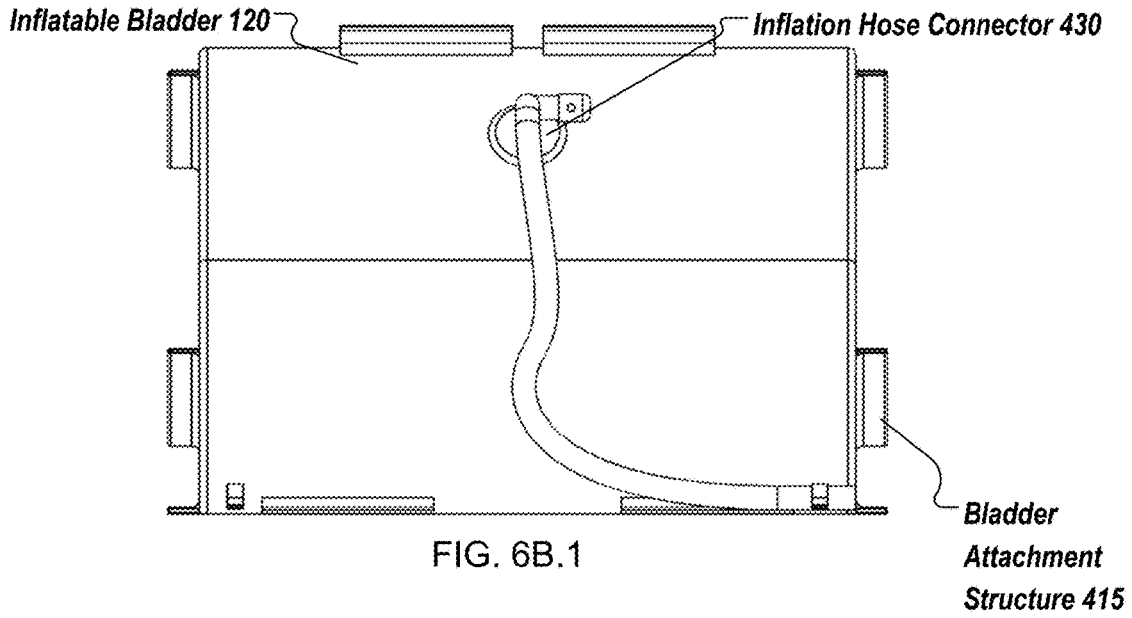
FIG. 6B.1
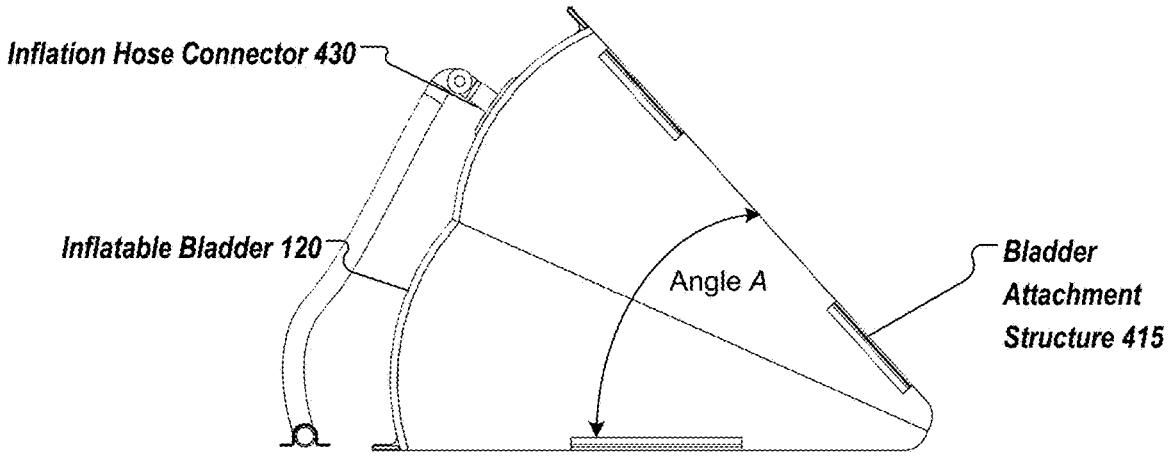
FIG. 6B.2
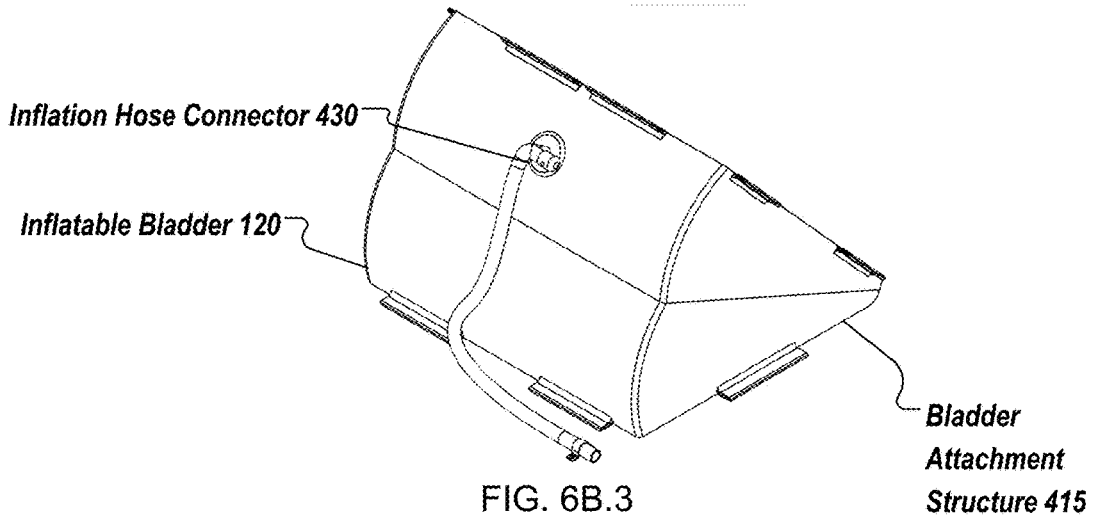
FIG. 6B.3

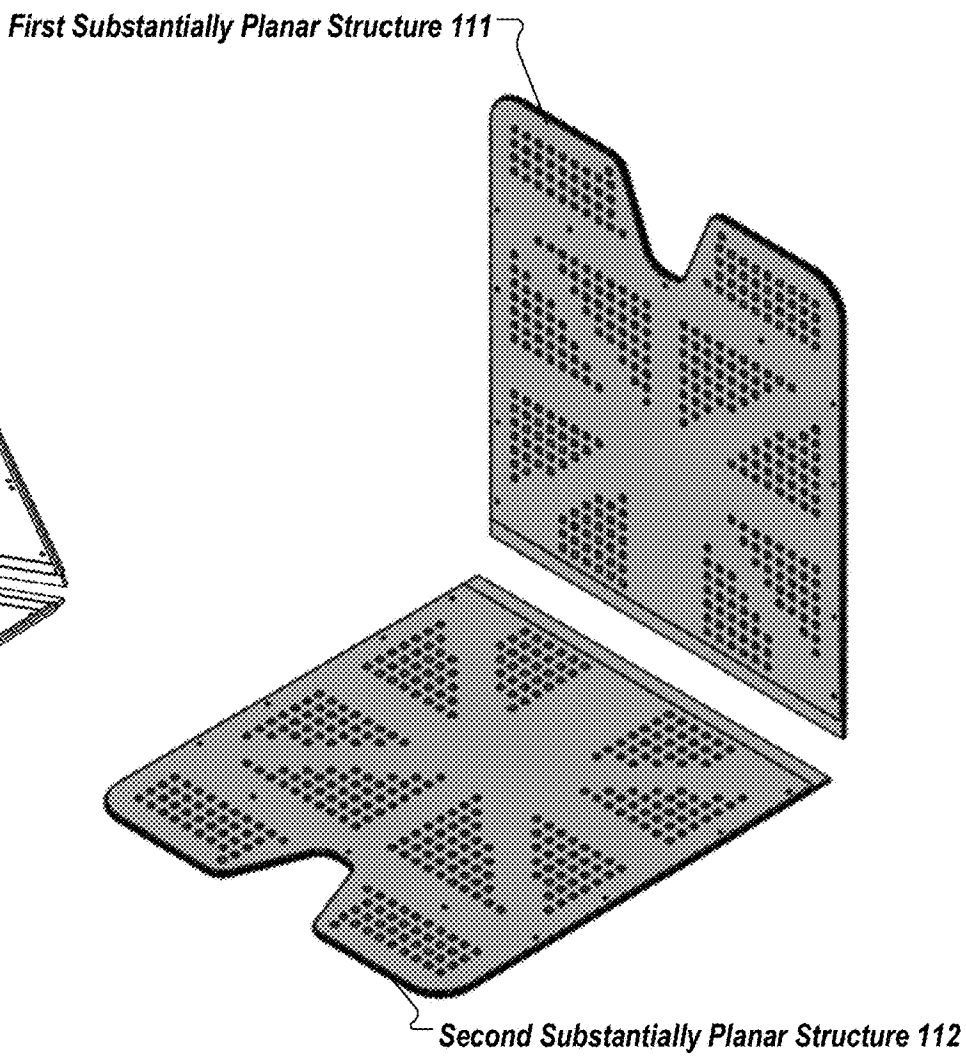
FIG. 6C.2
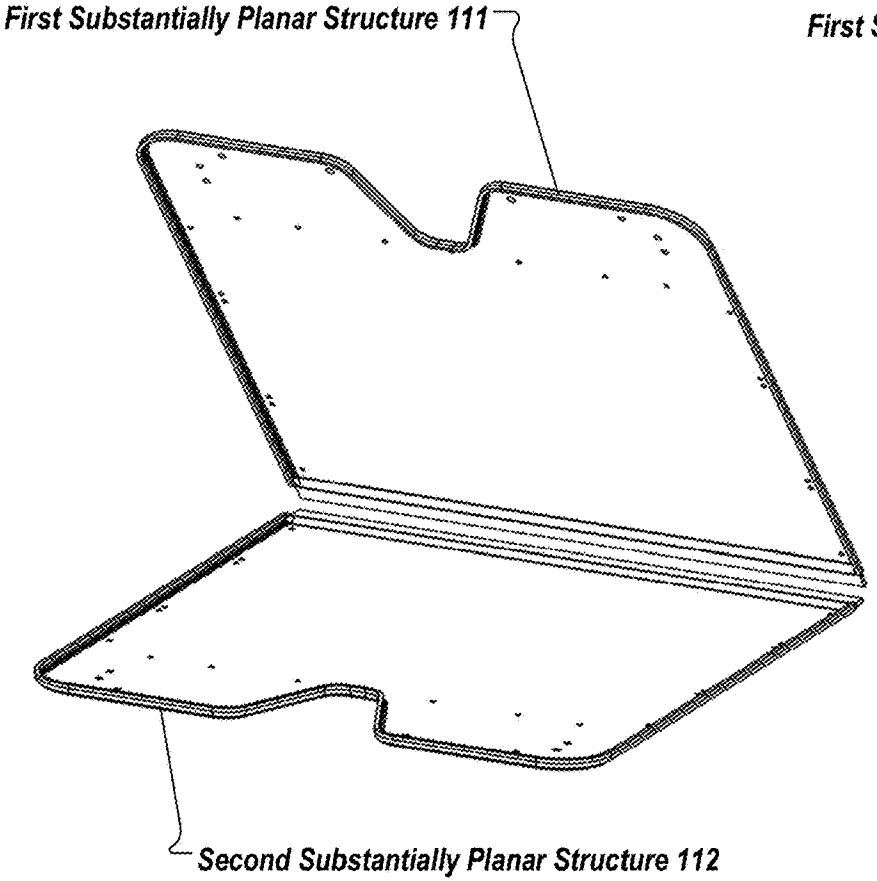
FIG. 6C.1

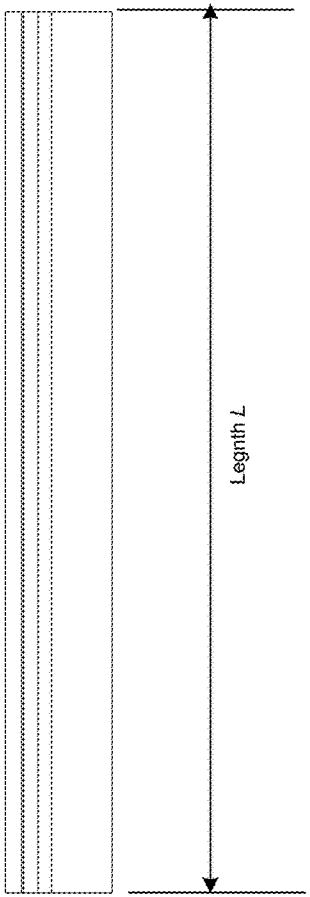
FIG. 7C
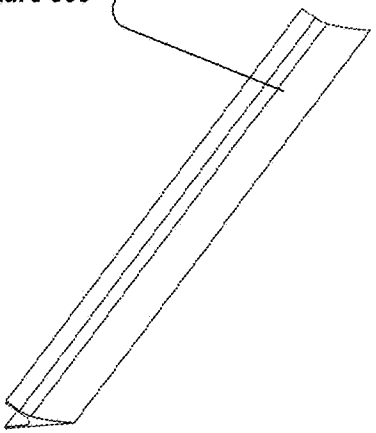
FIG. 7A.2
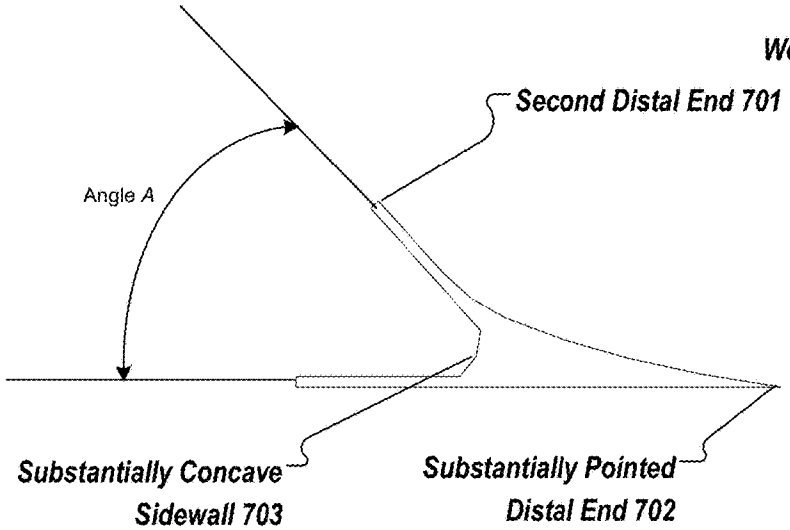
FIG. 7A.1
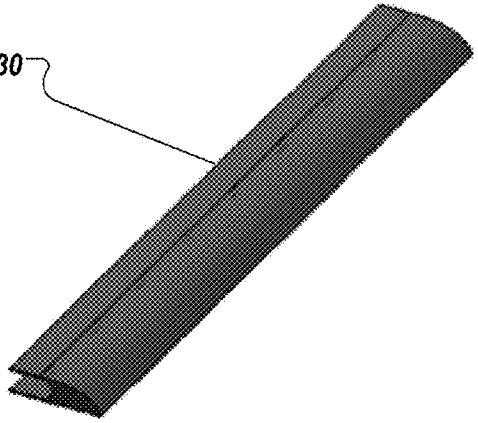
FIG. 7B.2
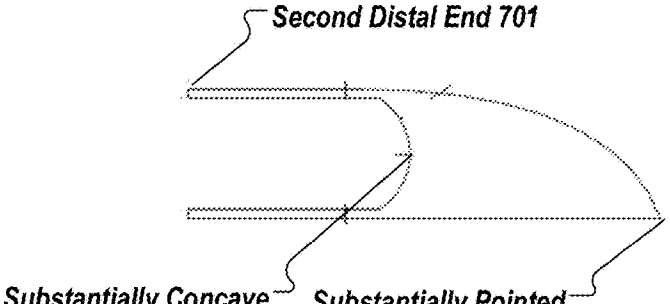
FIG. 7B.1

ADJUSTABLE SUPPORT DEVICE

RELATED APPLICATION

This application claims the benefit of Provisional Application No. 63/436,375, filed Dec. 30, 2022, the entire content of which is hereby incorporated by reference.

TECHNICAL FIELD

Embodiments of the present disclosure relate to support devices, and in particular to adjustable support devices.

BACKGROUND

Most individuals lay down at some point each day. These individuals may wish to be in a position other than completely horizontal when doing so. An individual can change this position using pillows or other similar materials.

BRIEF DESCRIPTION OF DRAWINGS

The present disclosure is illustrated by way of example, and not by way of limitation, in the figures of the accompanying drawings in which like references indicate similar elements. It should be noted that different references to "an" or "one" embodiment in this disclosure are not necessarily to the same embodiment, and such references mean at least one.

In consideration of the following detailed description, the embodiments may be more completely understood in connection with the following drawings.

FIGS. 7A.1-C illustrate wedge structures of support devices, according to certain embodiments.

DETAILED DESCRIPTION OF EMBODIMENTS

Figure 1A:
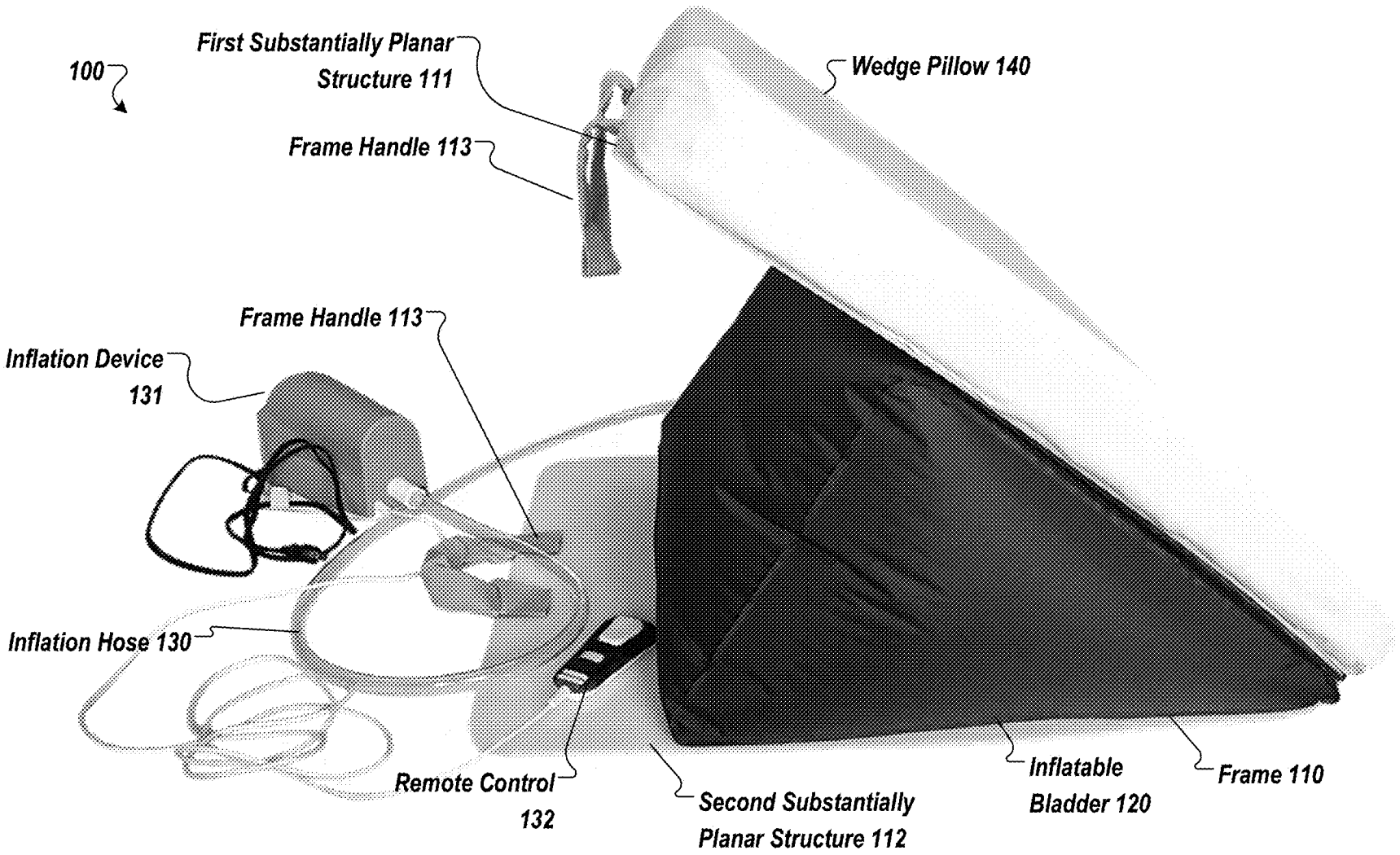
FIGS. 1A-B illustrate perspective views of support devices, according to certain embodiments.

Embodiments described herein are related to an adjustable support device (e.g., adjustable bed support device).

Most individuals lay down at some point each day. These individuals may wish to be in a position other than completely horizontal when doing so. Laying down typically takes place on a bed, but can occur in other places (e.g., couch, floor, cot, etc.).

Conventionally, individuals have to use supportive materials such as a pillow to prop themselves up from a horizontal position to an inclined position. This can take several adjustments and attempts to achieve a particular incline, and an individual may not have sufficient mobility to make such adjustments (e.g., due to injury or other medical condition, due to being tired, etc.). Additionally, some individuals may need to remain in an inclined position due to medical or other health related conditions. Given the difficulties in performing such an adjustment, individuals may have to choose to remain in an uncomfortable position for long periods of time, leading to poor well-being, poor health, and decreased quality of life.

The devices, systems, and methods of the present disclosure provide adjustable support devices. An adjustable support device includes a frame that includes a first substantially planar structure and a second substantially planar structure that are rotatably coupled to each other. In some embodiments, the first substantially planar structure and the second substantially planar structure are rotatably coupled via a hinge structure.

The adjustable support device further includes one or more frame attachment structures configured to be removably attached to the frame. In some embodiments, the frame attachment structure is a metal strip. In other embodiments, the frame attachment structure is a button. In other embodiments, the frame attachment structure is a clip.

The adjustable support structure further includes an inflatable bladder that includes walls that form an interior volume. The inflatable bladder further includes one or more bladder attachment structures that are attached to at least one of the walls of the inflatable bladder. The inflatable bladder has a material that forms a channel (e.g., the material is a loop) to create the bladder attachment structure and the frame attachment structure is inserted through the channel and fastened on either side to securely attach the inflatable bladder to the frame. Each bladder attachment structure forms a corresponding channel and a corresponding frame attachment structure is configured to be routed through the corresponding channel to secure the inflatable bladder to the frame. In some embodiments, the bladder attachment structure is a loop of material that forms a channel. In other embodiments, the bladder attachment structure is a plastic tube.

The inflatable bladder is configured to be inflated (e.g., increase in volume) from a first position (e.g., deflated position) to a second position (e.g., inflated position) to rotate the first substantially planar structure of the frame (e.g., around the hinge structure) relative to the second substantially planar structure (e.g., to create an inclined surface). The inflatable bladder may also be deflated by decreasing the volume until the first substantially planar structure of the frame has rotated back to the first position (e.g., original horizontal position). In some embodiments, the inflatable bladder is inflated by being filled with a fluid via an inflation hose. In some embodiments, the inflation hose may also be connected to an inflation device to facilitate filling the inflatable bladder with a fluid. In some embodiments, a cushion is attached to the first substantially planar structure of the frame that rotates around the hinge structure as the inflatable bladder increases and decreases in volume. In some embodiments, the inflatable bladder is controlled via a remote control that operates an inflation device.

The adjustable support structure further includes at least one stopper block structure that is attached to the frame. The stopper block structure acts to prevent wear-and-tear on the inflatable bladder by preventing the compression of the inflatable bladder to a height that is less than a threshold value between the first substantially planar structure and the second substantially planar structure of the frame. In some embodiments, the stopper block structure prevents the inflation hose from being compressed to a height that is less than a threshold value between the first substantially planar structure and the second substantially planar structure of the frame. In some embodiments, the stopper block structure is a wooden block. In other embodiments, the stopper block structure is a plastic block. In other embodiments, the stopper block structure includes rubber (e.g., coated with rubber, is made of rubber).

In some embodiments, the adjustable support structure further includes a wedge structure that is attached to the frame along the hinge structure. In some embodiments, the wedge structure is flexible and moves with the first substantially planar structure of the frame as the first substantially planar structure changes inclination. In some embodiments, the wedge structure is removably attached to the frame. In some embodiments, the wedge structure helps to eliminate a gap created by the hinge structure to improve the comfort of the adjustable support structure. In some embodiments, the wedge structure is made of a flexible rubber or plastic material.

The devices of the present disclosure have advantages over conventional solutions. The adjustable support device of the present disclosure can be used on a bed, couch, futon, cot, or any other substantially flat surface where an individual may lay down (e.g., the ground, sleeping bag, etc.) without the struggle of adjustment that accompanies conventional solutions. The adjustable support device can be adjusted via remote control of the inflation device, allowing the individual user to adjust the incline of the support device on their own and with relative ease compared to conventional solutions where assistance of another person is used to achieve an incline adjustment.

Although certain embodiments of the present disclosure describe adjustable support devices for a bed, in some embodiments, adjustable support devices of the present disclosure may be used in other locations (e.g., couch, futon, cot, substantially flat surface, non-flat surface, etc.).

Figure 1B:
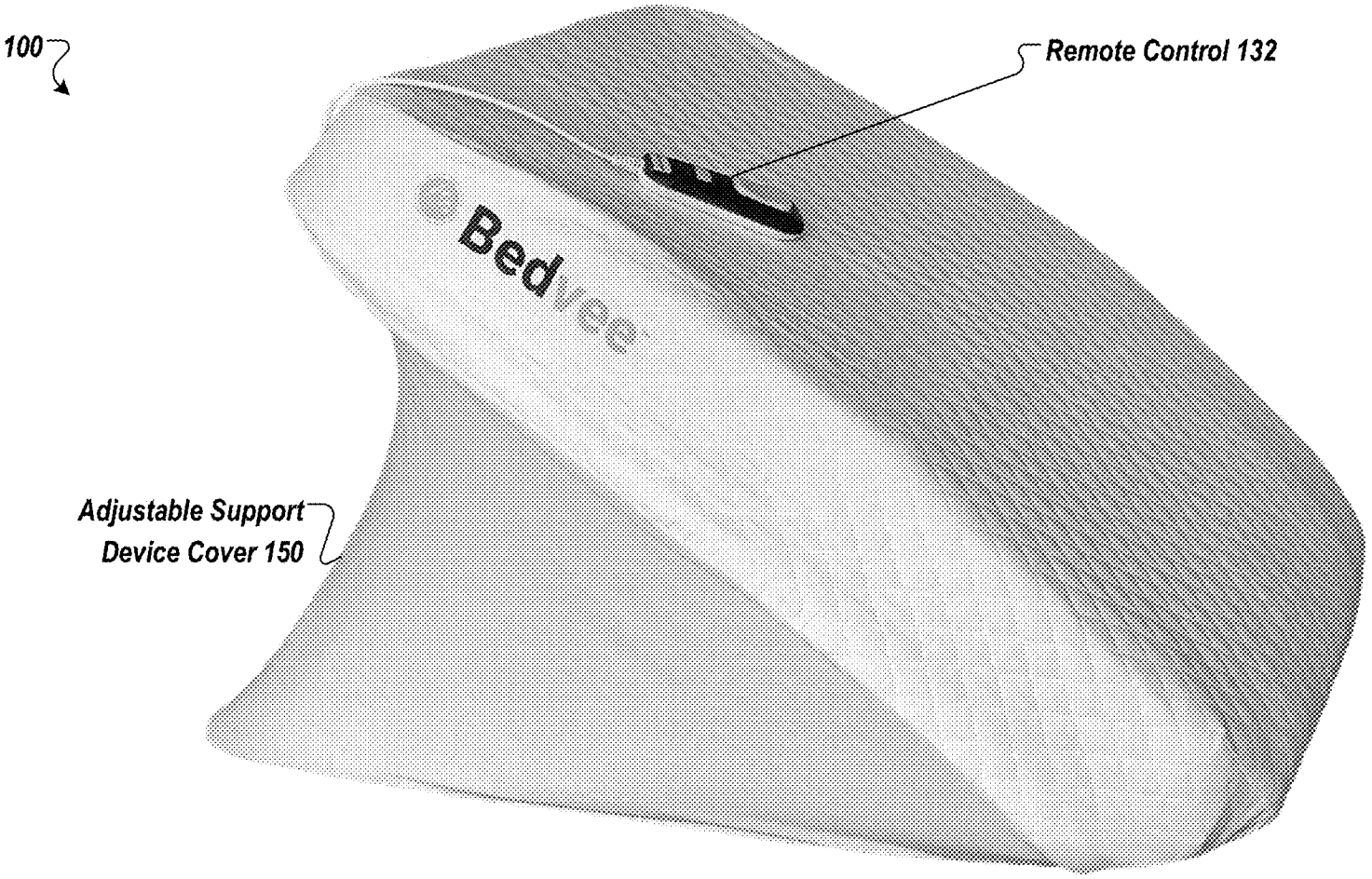

FIGS. 1A-B illustrate perspective views of support devices, according to certain embodiments. FIG. 1A illustrates a perspective view of an adjustable support device 100. FIG. 1B illustrates a perspective view of an adjustable support device 100 that is enclosed in an adjustable support device cover 150. In some embodiments, each of FIGS. 1A-B refers to the same adjustable support device 100.

Some embodiments of an adjustable support device 100 utilize a frame 110 that includes a first substantially planar structure 111 and a second substantially planar structure 112. Both the first substantially planar structure 111 and the second substantially planar structure 112 may be made of the same material, or they may each be a unique material. In some embodiments, a substantially planar structure (e.g., the frame structure) may be a made of a thermoplastic such as polycarbonate or polypropylene. The substantially planar structure made of this material could be thermoformed and pressed or made through an injection molding process to achieve the desired shape and size as described in this specification. In some embodiments, one or other portions of the adjustable support device 100 are made of thermoplastic (e.g., via thermoforming, injection molding, etc.). In some embodiments, the frame 110 comprises one or more of nylon or glass fiber (e.g., PA type 6+GF30 (Nylon+30% glass fiber)) which provides rigidity without exceeding a threshold weight. In some embodiments, the adjustable support device 100 (not including the pump) is less than 40 pounds (lb), about 10 to about 30 lb, about 15 to about 25 lb, about 18 to about 22 lb, about 19 to about 21 lb, or about 19.5 to about 20.5 lb. In some embodiments, the pump is less than 8 lb, about 2 to about 6 lb, about 3 to about 5 lb, or is about 3.5 to about 4.5 lb. The frame 110 may be shaped to be sturdy and to avoid being bent, especially in the middle of the frame 110 or where a person might lean over the frame 110 with their elbow.

In some embodiments, the substantially planar structure (e.g., the frame structure) is made by: designing the nerves of the wall (e.g., the upper surface of the substantially planar structure, where the upper surface is protrusions and recesses, plateaus and valleys, etc.); modelling of a model (computer-aided design (CAD) model) based on the designed nerves of the wall; manufacturing of the mold based on the model; thermoforming of the sheet on the mold to form a part (e.g., substantially planar structure, frame structure); performing measurement of the part to generate results; and performing analysis of the results (e.g., to determine that the part is correctly made).

In some embodiments, the substantially planar structure may be a sheet of metal. In some embodiments, the sheet of metal comprising the substantially planar structures may be perforated, and these perforations may help reduce the overall weight of the substantially planar structure, or for some other purpose. In some embodiments, a substantially planar structure may be a molded plastic structure which may also be perforated. In some embodiments, a substantially planar structure may be a wooden board.

An inflatable bladder 120 is attached to the frame between the first substantially planar structure 111 and the second substantially planar structure 112. In some embodiments, the inflatable bladder 120 has multiple walls that create an internal volume. The location at which more than one wall meet and are proximate either the first substantially planar structure 111 or the second substantially planar structure 112 is an edge of the inflatable bladder 120, and the inflatable bladder 120 may have multiple edges. In some embodiments, the inflatable bladder 120 is made of polyvinyl chloride (PVC). In some embodiments, a frame handle 113 is attached to the frame 110. In some embodiments, a first frame handle 113 is attached to the first substantially planar structure 111 and a second frame handle 113 is attached to the second substantially planar structure 112. In some embodiments, the first frame handle 113 is attached to the first substantially planar structure 111 proximate a first distal end of the first substantially planar structure 111 and the second frame handle 113 is attached to the second substantially planar structure 112 proximate a first distal end of the second substantially planar structure 112, where a second distal end of the first substantially planar structure 111 is rotatably coupled to a second distal end of the second substantially planar structure 112. In some embodiments, the frame handle 113 may include a fabric handle with a rubber grip, fixated to the first substantially planar structure 111 or the second substantially planar structure 112 via a fixator (e.g., nut and bolt, screw, etc.).

In some embodiments, an inflation hose 130 is connected to the inflatable bladder 120 and an inflation device 131. In some embodiments, the inflation device 131 is configured to adjust an internal pressure of the inflatable bladder 120 to adjust the internal volume of the inflatable bladder, which in turn adjusts the distance and elevation between the first substantially planar structure 111 and the second substantially planar structure 112. The inflation device 131 may be controlled, in some embodiments, by a remote control 132 that operates the inflation device 131. Further, as shown in FIG. 1A, in some embodiments, a wedge pillow 140 may be attached to the first substantially planar structure 111.

FIG. 1A is representative of an adjustable support device 100 when the inflatable bladder 120 is inflated with a fluid and has an inner volume. The inner volume of the inflatable bladder 120 is adjustable via the inflation hose 130 and the inflation device 131. When the inner volume of the inflatable bladder 120 is substantially zero, the first substantially planar structure 111 and the second substantially planar structure 112 fold toward each other. In some embodiments, the adjustable support device 100 is a collapsible support device because of this ability to completely compress the frame to a minimal width when the inflatable bladder 120 is deflated.

FIG. 1B shows an embodiment where the adjustable support device 100 is covered with an adjustable support device cover 150. In some embodiments, the adjustable support device cover 150 may be a fabric that stretches to cover the entire adjustable support device 100 (or substantially the entire adjustable support device 100) in the non-inflated and inflated positions. In some embodiments, the adjustable support device cover 150 may have an elastic band to stay connected to the lower planar structure of the frame (e.g., a fitted bed sheet). In some embodiments, the adjustable support device cover 150 may have a drawstring to tighten an opening in the bottom portion of the adjustable support device cover 150 and secure the adjustable support device cover 150 to the lower planar structure of the frame.

FIGS. 2A-E illustrate components of support devices (e.g., adjustable support devices 100), according to certain embodiments. Support devices may include a frame. In some embodiments, the frame includes a first substantially planar structure 111 and a second substantially planar structure 112. In some embodiments, the first substantially planar structure 111 and the second substantially planar structure 112 are rotatably coupled to each other via a hinge structure 200.

In some embodiments, the first substantially planar structure 111 and the second substantially planar structure 112 are substantially the same dimension as each other. The first substantially planar structure 111 and the second substantially planar structure 112 are rotatably coupled via a hinge structure 200. In some embodiments, the hinge structure is connected to a second distal end of the first substantially planar structure 111 and a second distal end of the second substantially planar structure 112. In some embodiments, a first frame handle 113 is attached to a first distal end of the first substantially planar structure 111 and a second frame handle 113 is attached to a first distal end of the second substantially planar structure 112, where the first distal end of the first substantially planar structure 111 and the first distal end of the second substantially planar structure 112 is distal to the hinge structure 200. In some embodiments, the corners of the first distal end of the first substantially planar structure 111 and the corners of the first distal end of the second substantially planar structure 112 may be rounded. In some embodiments, the corners of the first substantially planar structure 111 and the second substantially planar structure 112 may form an angle of about 90 degrees (e.g., a right angle). In some embodiments, the first substantially planar structure 111 and the second substantially planar structure 112 may be a variety of shapes, including rectangular, square, rounded, abstract, etc. In some embodiments, the first substantially planar structure 111 and the second substantially planar structure 112 may have a first length of about 20-30 inches and a second length of about 20-30 inches. In some embodiments, the first substantially planar structure 111 and the second substantially planar structure 112 have different dimensions than described here.

Figure 2B:
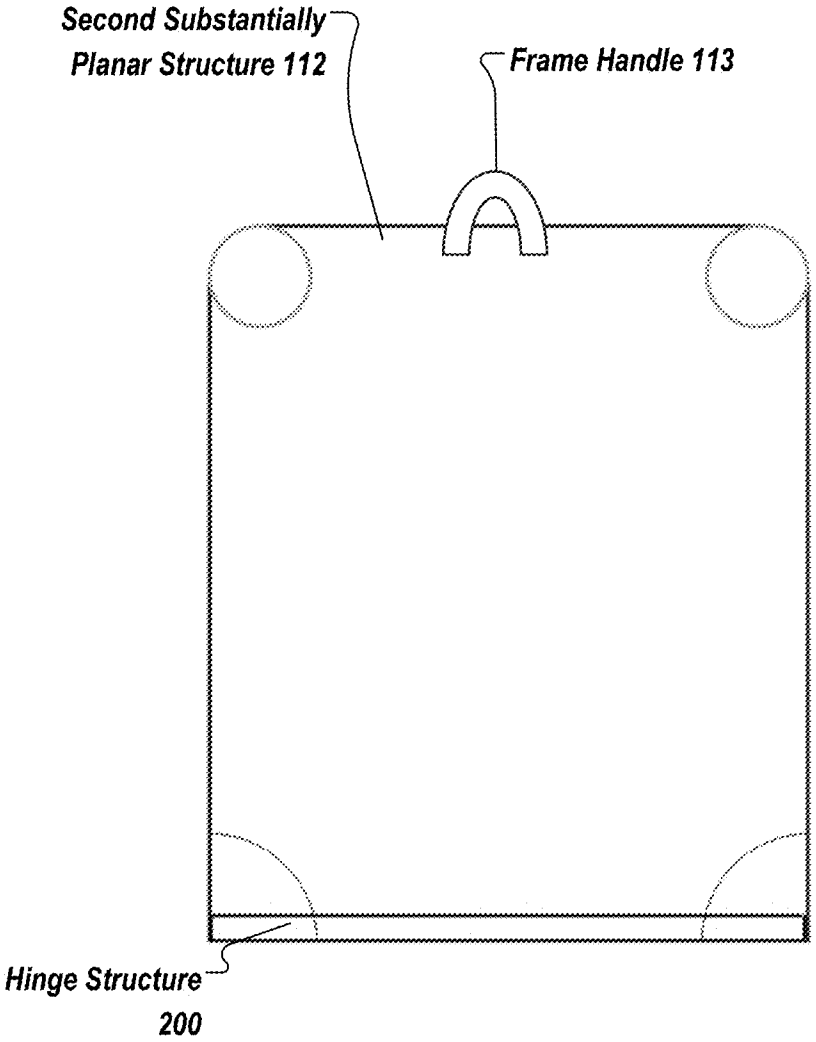
FIGS. 2A-E illustrate components of support devices, according to certain embodiments.
Figure 2A:
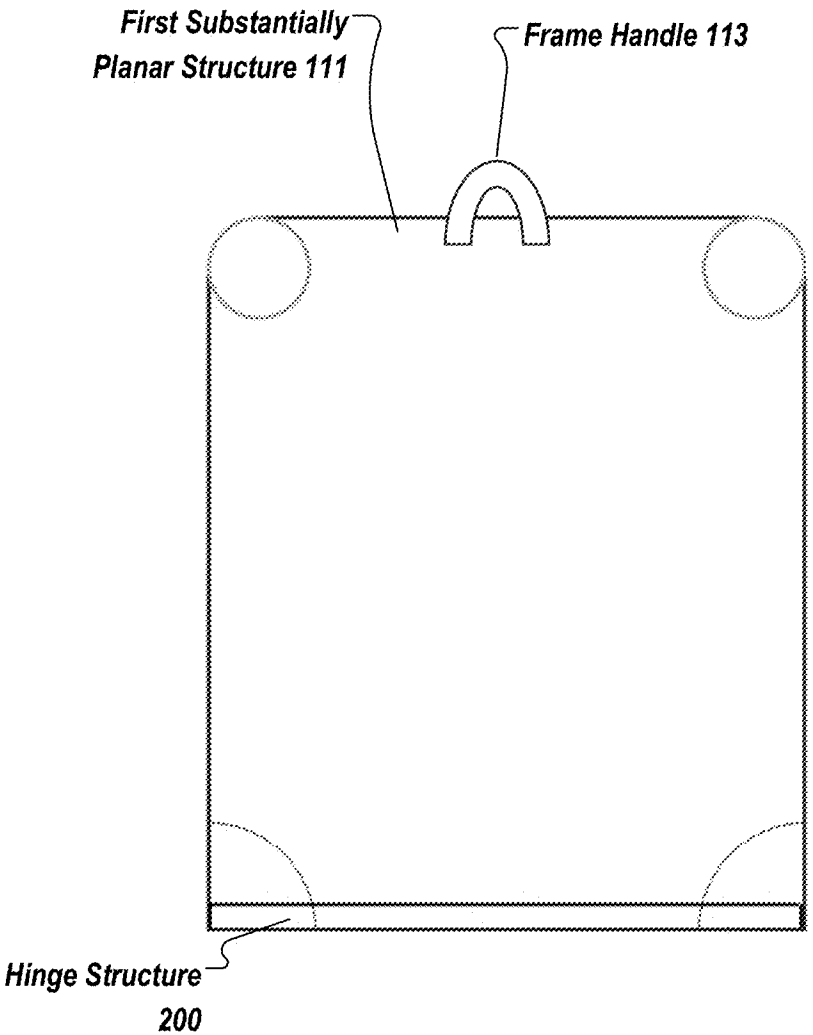
Figure 2D:
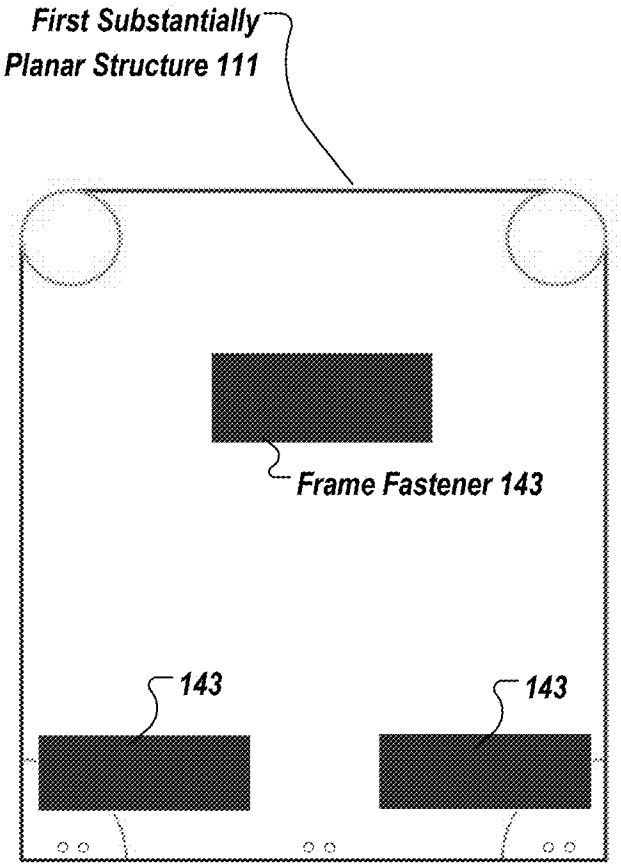
Figure 2C:
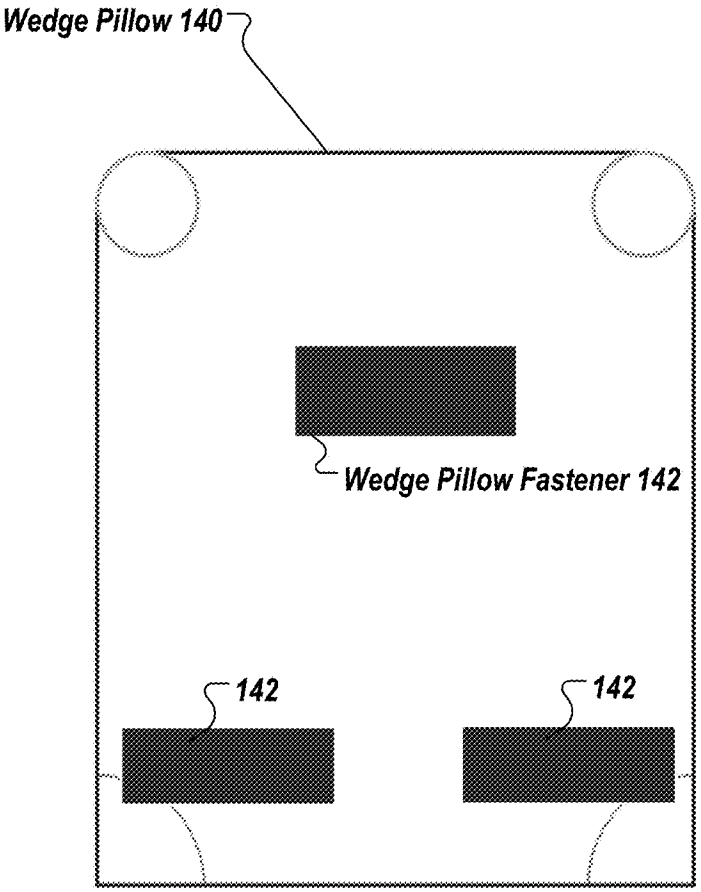

FIG. 2C shows an embodiment of a wedge pillow 140 with at least one wedge pillow fastener 142 attached to the wedge pillow 140. In some embodiments, the wedge pillow 140 may have a first length of about 25-35 inches, and a second length of about 20-30 inches. In some embodiments, the wedge pillow 140 may have a first length that is not less than a first length of the first substantially planar structure 111. In some embodiments, the wedge pillow 140 may have a second length that is substantially the same as a second length of the first substantially planar structure 111.

FIG. 2D shows an embodiment of a first substantially planar structure 111 with at least one frame fastener 143 attached to the first substantially planar structure 111. Each wedge pillow fastener 142 corresponds to a frame fastener 143, which is attached to the first substantially planar structure 111. In some embodiments, the one or more frame fastener 143 is attached to a first surface of the first substantially planar structure 111, where a second surface of the first substantially planar structure 111 is attached to the inflatable bladder (e.g., inflatable bladder 120 in FIG. 1A). In some embodiments, the wedge pillow 140 can be attached to the first substantially planar structure 111 by coupling (e.g., connecting) the wedge pillow fastener 142 to the corresponding frame fastener 143. In some embodiments, the wedge pillow fastener 142 and the frame fastener 143 may be a hook and loop material (e.g., Velcro®), a button and button hole, snap fasteners, or magnets. In some embodiments, the wedge pillow 140 is substantially the same shape as the first substantially planar structure 111.

Figure 2E:
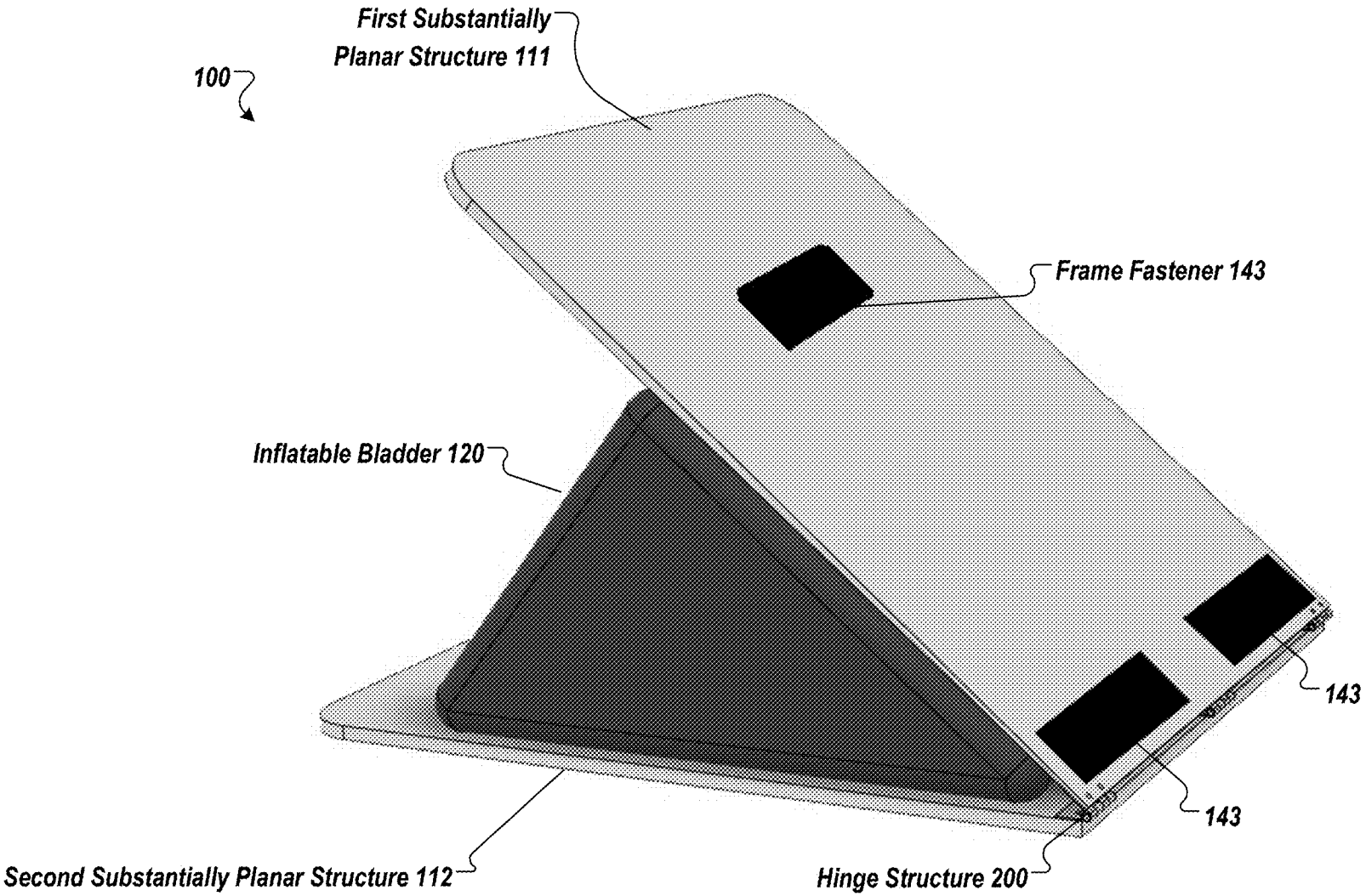

FIG. 2E shows an embodiment of an adjustable support device 100 with a first substantially planar structure 111 and a second substantially planar structure 112, which are rotatably coupled via a hinge structure 200. An inflatable bladder 120 is positioned between the first substantially planar structure 111 and the second substantially planar structure 112. In some embodiments, one or more frame fastener 143 are attached to the first substantially planar structure 111 on a first surface opposite a second surface, where the second surface is attached to the inflatable bladder 120.

Figure 3B:
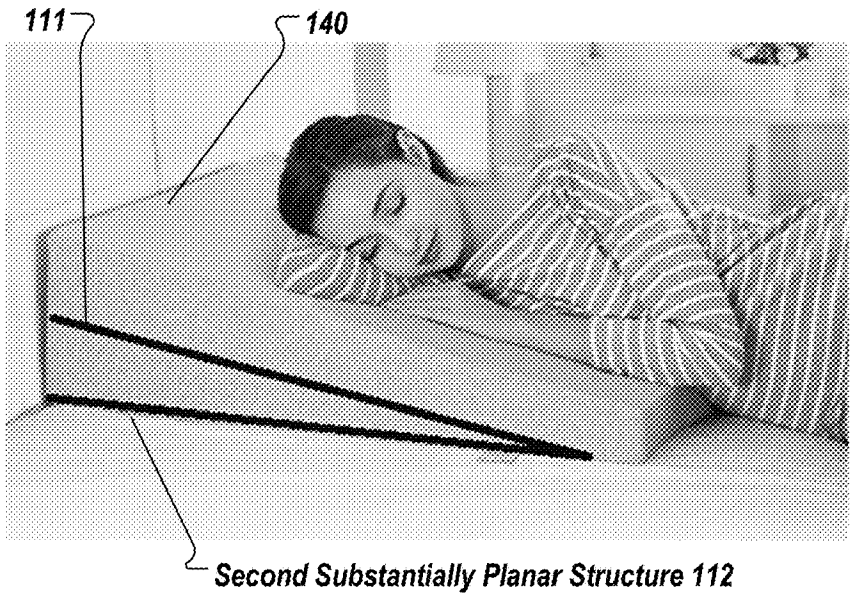
FIGS. 3A-B illustrate components of support devices, according to certain embodiments.
Figure 3A:
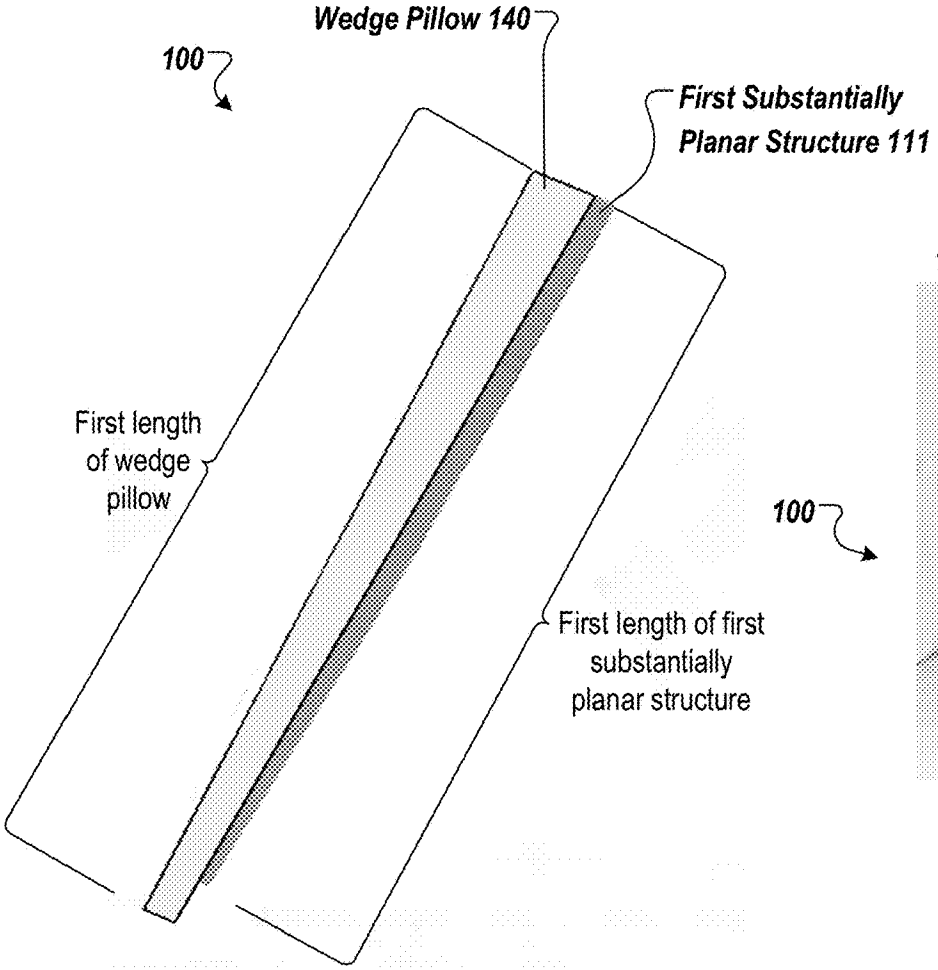

FIGS. 3A-B illustrate components of support devices, according to certain embodiments.

FIG. 3A shows a perspective of part of an adjustable support device 100. In some embodiments, a wedge pillow 140 may be attached to a first substantially planar structure 111 of a frame of an adjustable support device. In some embodiments, the wedge pillow 140 may include a wedge shaped mattress foam 300. In some embodiments, a first length of the wedge pillow 140 may be greater than a first length of the first substantially planar structure 111.

FIG. 3B shows a perspective view of an adjustable support device 100. In some embodiments, a wedge pillow 140 may be attached to a first substantially planar structure 111. The perspective view illustrated in FIG. 3B shows the adjustable support device 100 in an inflated position, such that the first substantially planar structure 111 is elevated from a second substantially planar structure 112. The inflated position is achieved via an inflatable bladder (e.g., inflatable bladder 120 in FIG. 1A).

Figure 4A:
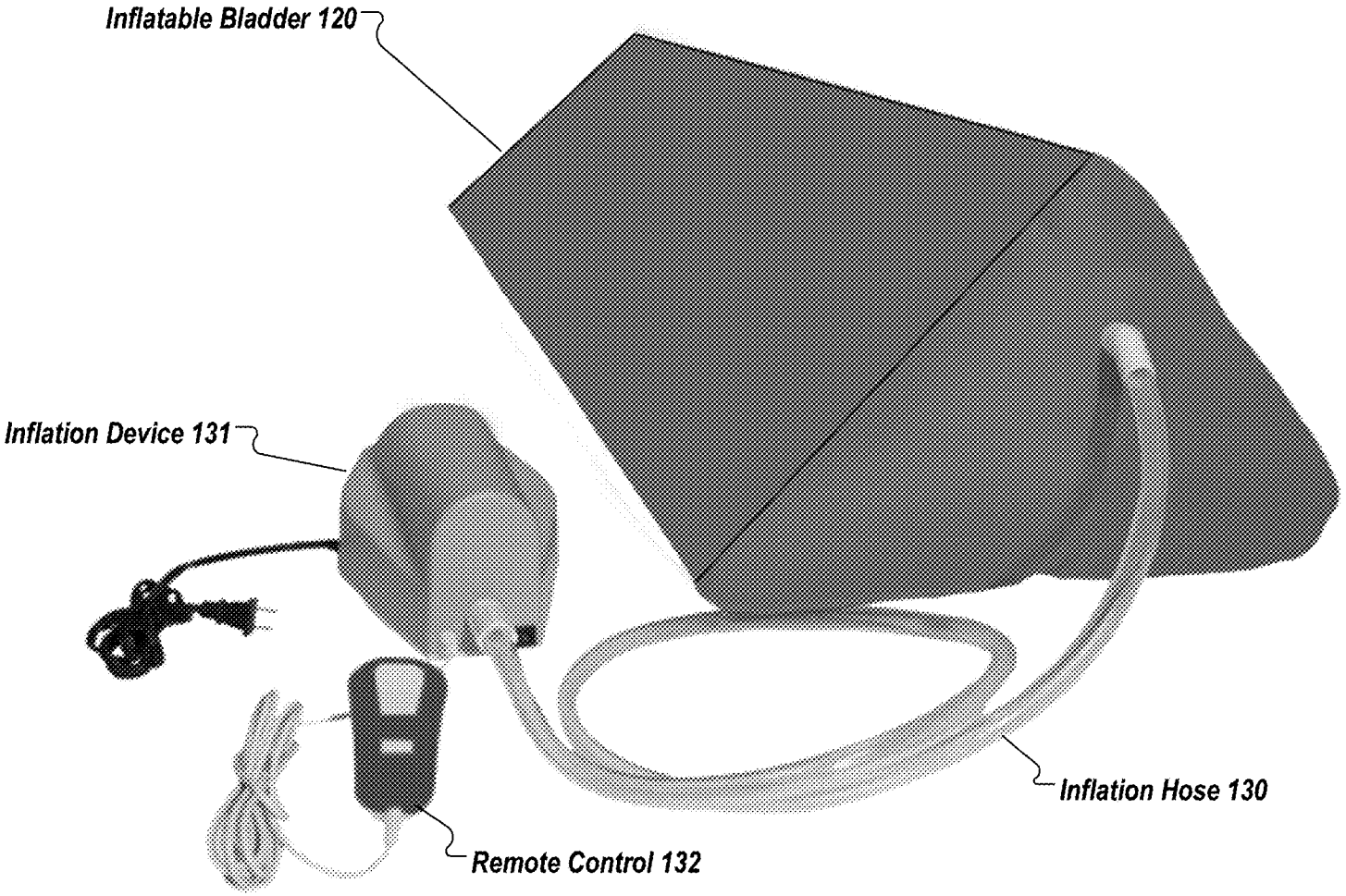
FIGS. 4A-C illustrate components of support devices, according to certain embodiments.
Figure 4B:
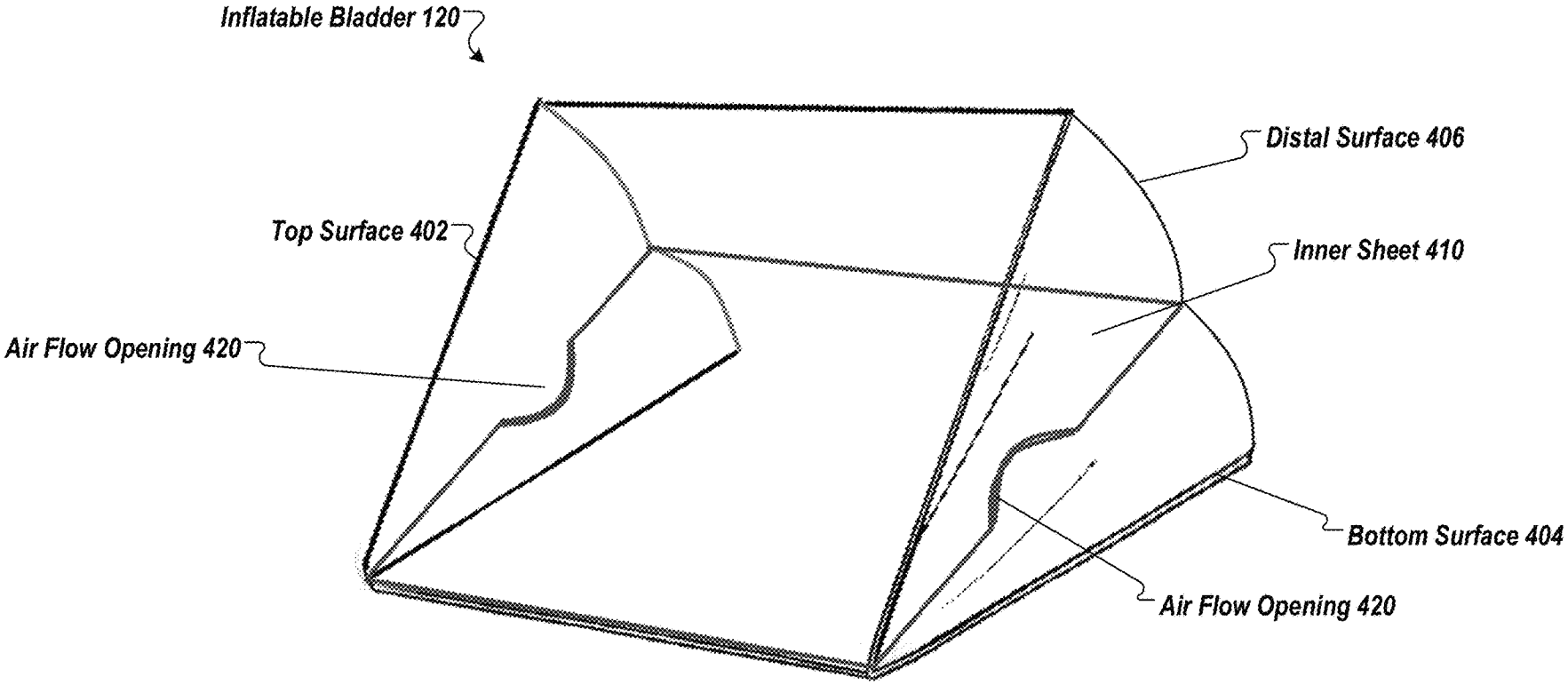
Figure 4C:
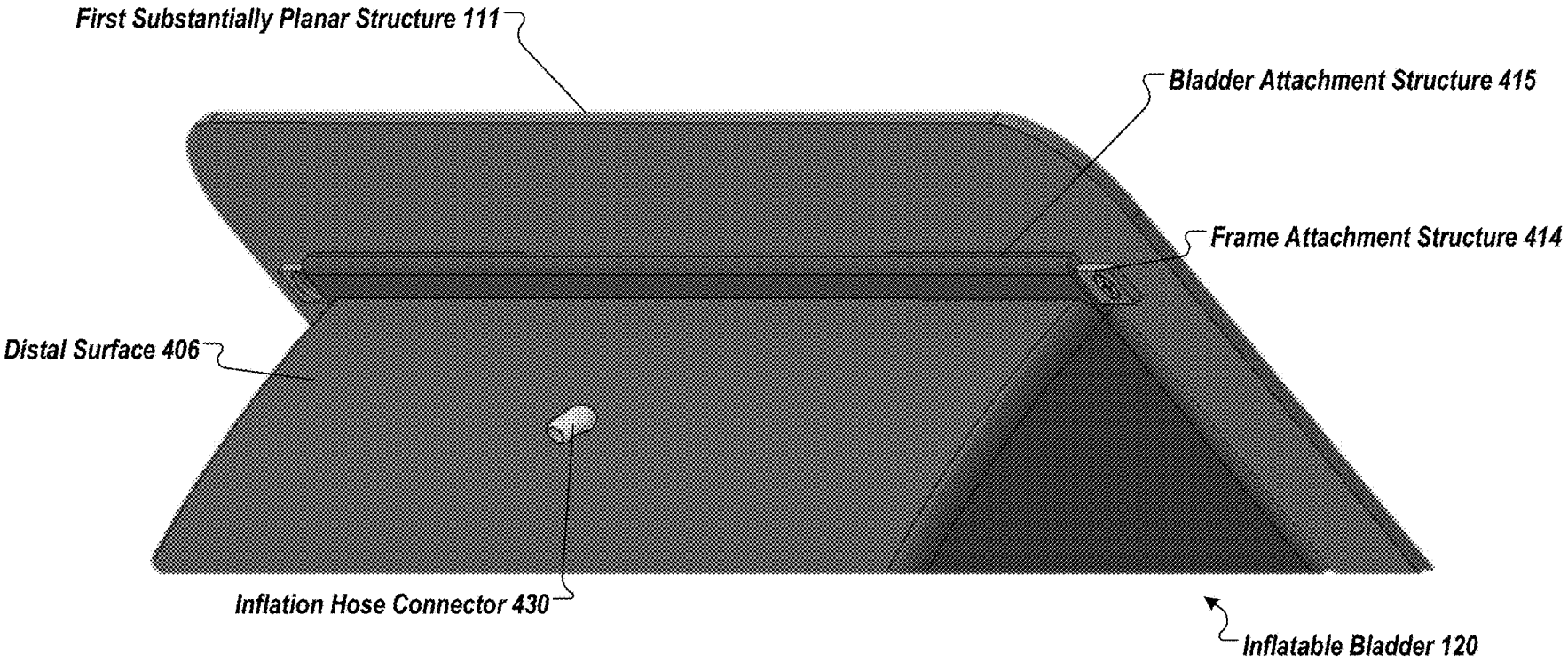

FIGS. 4A-C illustrate components (e.g., inflatable bladder 120, etc.) of adjustable support device 100, according to certain embodiments.

FIG. 4A shows a perspective view of an inflatable bladder 120. In some embodiments, an inflation hose 130 has a first distal end connected (e.g., fluidly coupled) to the inflatable bladder 120 and a second distal end connected (e.g., fluidly coupled) to an inflation device 131. In this configuration, the inflation hose 130 permits fluid to pass from the inflation device 131 to the inflatable bladder 120 to inflate the inflatable bladder 120. In some embodiments, the fluid is air. In some embodiments, the fluid may be a liquid or other type of fluid that permits the inflatable bladder 120 to inflate and deflate to various positions. In some embodiments, the inflation device 131 may be operated and controlled by a remote control 132. In some embodiments, the inflatable bladder 120 has a first length, a second length, a third length, and a fourth length that substantially define the internal volume. In some embodiments, the first length substantially aligns with the first substantially planar structure (e.g., first substantially planar structure 111 in FIG. 1A) and is about 16-23 inches long. A second length of the inflatable bladder 120 substantially aligns with the second substantially planar structure (e.g., second substantially planar structure 112 in FIG. 1A) and is about 16-23 inches. A third length of the inflatable bladder 120 substantially aligns with the hinge structure of the frame (e.g., hinge structure 200 in FIG. 2A) and is about 18-24 inches. A fourth length of the inflatable bladder 120 faces away from the hinge structure (e.g., hinge structure 200 in FIG. 2A) and is about 13-19 inches. In some embodiments the first, second, third, and fourth lengths may be different than disclosed here. The inflatable bladder 120 may include a variety of materials, such as vinyl, fabric, rubber, polyurethane, etc. In some embodiments, the material of the inflatable bladder 120 has a thickness above a threshold amount (e.g., about 1-4 mm) to sustain a threshold weight of a person (e.g., about 250 lbs.) for extended periods of time.

FIG. 4B illustrates an embodiment of the inflatable bladder 120 where an inner sheet 410 is a structure within the inflatable bladder 120 that creates two internal chambers. A fluid (e.g., air) may pass between the two internal chambers in some embodiments via a plurality of air flow openings 420. In some embodiments, there may be a plurality of inner sheets 410, which creates a plurality of internal chambers. In some embodiments, the inner sheet 410 may be made of a plastic polymer such as polyvinyl chloride (PVC). In some embodiments, the inflatable bladder 120 is configured to attach to the first substantially planar structure (e.g., first substantially planar structure 111 in FIG. 1A) along the top surface 402 and to the second substantially planar structure (e.g., second substantially planar structure 112 in FIG. 1A) along the bottom surface 404. Further, the distal surface 406 is configured to be opposite from the hinge structure (e.g., hinge structure 200 in FIG. 2A).

FIG. 4C illustrates an embodiment of an inflatable bladder 120 attached to a first substantially planar structure 111 by a frame attachment structure 414 and bladder attachment structure 415. In some embodiments, the bladder attachment structure 415 and/or the frame attachment structure 414 may be located in different locations than shown in the FIGS. The inflatable bladder 120 has an inflation hose connector 430, which is used to connect the inflation hose to the inflatable bladder. In some embodiments, the inflation hose connector 430 is pointing downward toward the second substantially planar structure (e.g., second substantially planar structure 112 in FIG. 1A) in order to support improved connection with the inflation hose. The bladder attachment structure 415 and the frame attachment structure 414 of the present disclosure securely fasten the inflatable bladder to the frame while avoiding damage to the inflatable bladder 120. In order to attach the inflatable bladder 120 to the frame, the frame attachment structure 414 is inserted through the channel formed by the bladder attachment structure 415. The bladder attachment structure 415 is above a threshold length that prevents damage (e.g., ripping) to the inflatable bladder 120 when inflated to a maximum volume. The frame attachment structure 414 has a length greater than the length of the bladder attachment structure 415, and ranges from about 3-12 inches. In some embodiments, the frame attachment structure 414 is centered with the bladder attachment structure 415, allowing the two distal ends of the frame attachment structure 414 to protrude past the two distal ends of the bladder attachment structure 415. In this configuration, the bladder attachment structure 415 is disposed around a central portion of the frame attachment structure 414, allowing the two distal ends of the frame attachment structure 414 to have direct contact with the first substantially planar structure 111 in order to be fastened there.

Figure 5A:
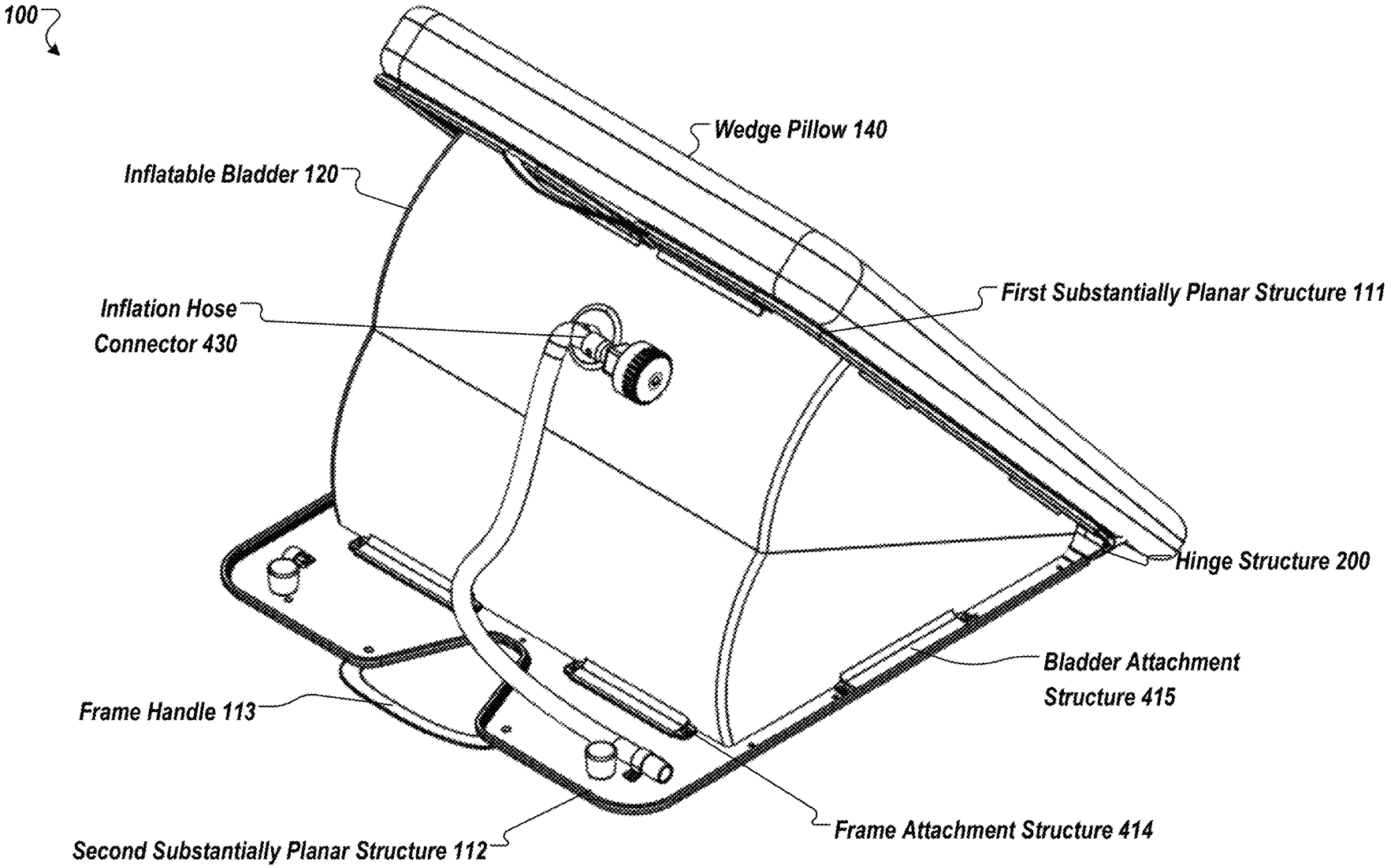
FIGS. 5A-B illustrate components of support devices, according to certain embodiments.
Figure 5B:
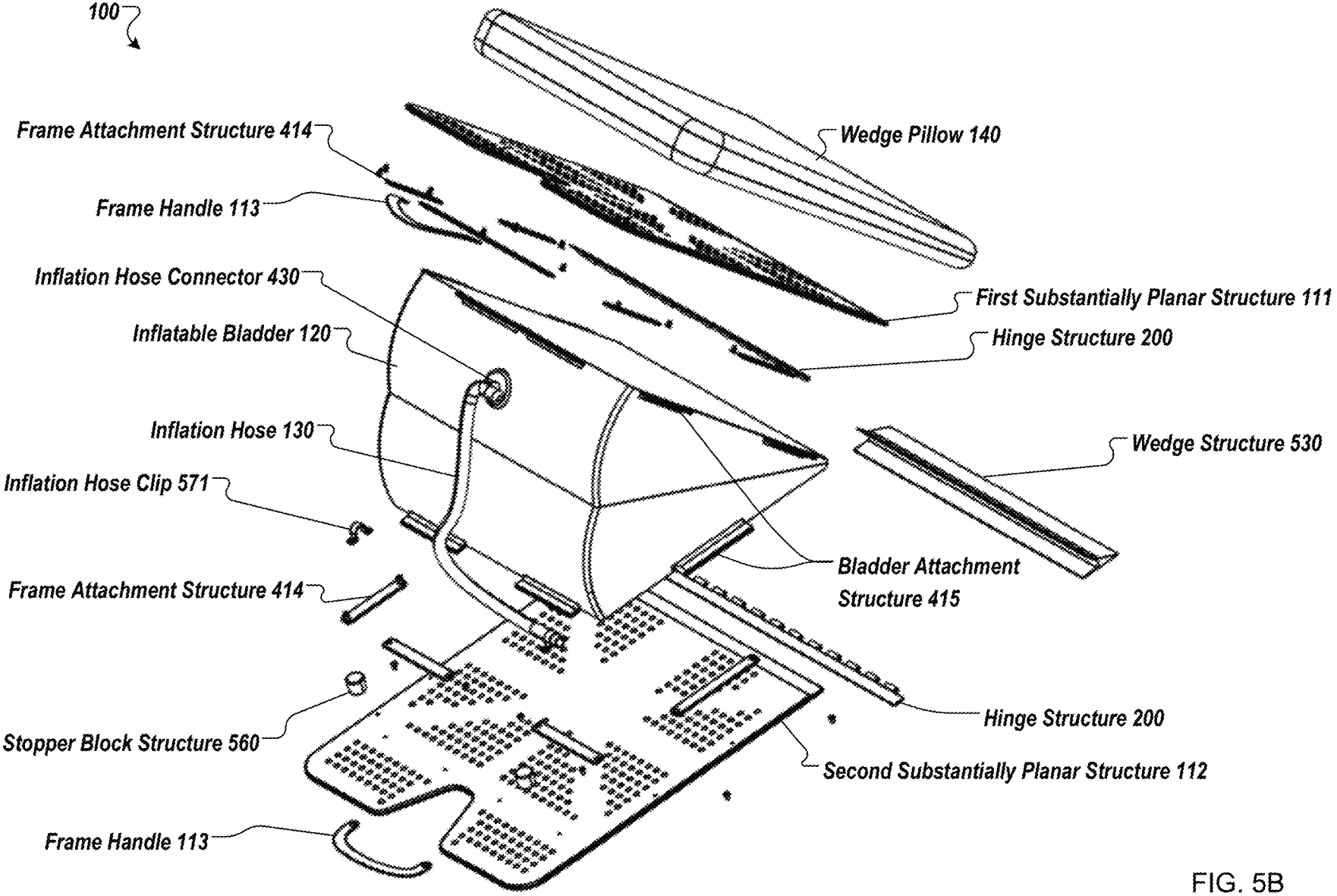

FIGS. 5A-B illustrate components of support devices, according to certain embodiments.

FIG. 5A illustrates a three-dimensional embodiment of an adjustable support device 100. The adjustable support device 100 includes a first substantially planar structure 111, a second substantially planar structure 112, a frame handle 113, and inflatable bladder 120, a wedge pillow 140, a hinge structure 200, multiple frame attachment structures 414, multiple bladder attachment structures 415, and an inflation hose connector 430.

FIG. 5B provides an exploded view of an adjustable support device, which shows exemplary components of an embodiment of an adjustable support device. An adjustable support device 100 has a frame in some embodiments with a first substantially planar structure 111 and a second substantially planar structure 112. The first substantially planar structure 111 is rotatably coupled to the second substantially planar structure 112 via a hinge structure 200. In some embodiments, the hinge structure 200 is a piano hinge, where a long rod runs through the knuckles of the hinge's two long leaves. In other embodiments, the hinge structure 200 is a pliant, flexible plastic piece that can fold and unfold. The hinge structure 200 allows the first substantially planar structure 111 to rotate away from the second substantially planar structure 112 to create an incline.

In some embodiments, the frame may further comprise a frame handle 113 attached to the first substantially planar structure 111 and the second substantially planar structure 112. In some embodiments, the frame handle 113 is a fabric strap used for carrying the adjustable support device. In other embodiments, the frame handle 113 has a plastic support to reinforce the handle and improve comfort and grip.

An inflatable bladder 120 is illustrated being between the first substantially planar structure 111 and the second substantially planar structure 112. The inflatable bladder 120 is attached to the frame of the adjustable support device 100 via frame attachment structures 414 and bladder attachment structures 415. In order to attach the inflatable bladder 120 to the frame, the frame attachment structure 414 is inserted through the channel formed by the bladder attachment structure 415.

In some embodiments, a wedge structure 530 is attached to the frame along the hinge structure 200. The wedge structure 530 may be made of a material such as thermoplastic polyurethane (TPU) which allows one side of the wedge structure to flex and move with the first substantially planar structure 111 as it raises and lowers.

In some embodiments, a stopper block structure 560 is attached to the frame. In some embodiments, the stopper block structure 560 is attached to the second substantially planar structure 112. The stopper block structure 560 is a substantially cylindrical shape in some embodiments. The stopper block structure 560 may have a substantially cylindrical shape that has a taper towards the frame, so that the wider portion is further from the frame and the narrower portion is closer to the frame. In some embodiments, the stopper block structure 560 has a height slightly greater than the deflated height of the inflatable bladder 120, wherein the deflated height of the inflatable bladder 120 corresponds to the height of the inflatable bladder 120 when substantially all of the fluid has been removed from the inflatable bladder 120. In some embodiments, the stopper block structure 560 has a height slightly greater than the outer diameter of the inflation hose 130, wherein the outer diameter of the inflation hose 130 corresponds to the external diameter of the inflation hose 130. In some embodiments, the stopper block structure 560 may be attached to the first substantially planar structure 111, rather than the second substantially planar structure 112. In some embodiments, a first stopper block structure 560 may be attached to the first substantially planar structure 111 and a second stopper block structure 560 may be attached to the second substantially planar structure 112. In some embodiments, the stopper block structure 560 is made of wood and attached to the frame via a screw. In other embodiments, the stopper block structure 560 is made of plastic. The stopper block structure 560 is secured to the frame via a fastener or an adhesive. In some embodiments, the stopper block structure 560 may be fastened, welded, soldered, adhered, or otherwise affixed to the frame.

In some embodiments, an inflation hose 130 is attached to the inflatable bladder 120. An inflation hose clip 571 acts to secure the inflation hose 130 to the frame. The inflation hose clip 571 is attached to the second substantially planar structure 112 in some embodiments, or to the first substantially planar structure 111 in other embodiments. In some embodiments, the inflation hose clip 571 may be opened to allow for the inflation hose 130 to be removed.

In some embodiments, a wedge pillow 140 is attached to the first substantially planar structure 111.

FIGS. 6A.1-E illustrate components of support devices, according to certain embodiments, including a frame, inflatable bladder, and frame attachment structures that may be used in some embodiments of an adjustable support device.

FIG. 6A.1 illustrates a front view of a support device and FIG. 6A.2 illustrates a side view of a support device. FIGS. 6A.1-6A.2 may illustrate an exemplary frame and inflatable bladder 120. Angle A is an angle to which the first substantially planar structure may be raised. A perspective view of an adjustable support device 100 includes a first substantially planar structure 111 and a second substantially planar structure 112 rotatable coupled via a hinge structure 200. An inflatable bladder 120 is configured between the first substantially planar structure 111 and the second substantially planar structure 112. In some embodiments, a frame handle 113 may be affixed to a first distal end of the first substantially planar structure 111, where the first distal end is distal to the hinge structure 200. In some embodiments, a frame handle 113 may also be affixed to a second distal end of the second substantially planar structure 112, where the second distal end is distal to the hinge structure 200.

A bladder attachment structure 415 is attached to the inflatable bladder 120 and is used to affix the inflatable bladder 120 to the frame via a frame attachment structure 414. In some embodiments, the inflatable bladder 120 may also include an inflation hose connector 430. In some embodiments, the inflation hose connector 430 is used to fluidly couple the inflatable bladder 120 with an inflation hose (e.g., inflation hose 130 in FIG. 1A) to allow for fluid to inflate the inflatable bladder 120 from a first position to a second position, where the difference between the first position and the second position can be seen in the change in Angle A.

FIGS. 6B.1-6B.3 illustrate various views of an embodiment of an inflatable bladder 120. FIG. 6B.1 illustrates a front view of an inflatable bladder, FIG. 6B.2 illustrates a side view of an inflatable bladder 120, and FIG. 6B.3 illustrates a perspective view of an inflatable bladder 120. A bladder attachment structure 415 is attached to the inflatable bladder 120 and is used to affix the inflatable bladder 120 to the frame via a frame attachment structure (e.g., frame attachment structure 414 in FIG. 4C). In some embodiments, the inflatable bladder 120 may also include an inflation hose connector 430. In some embodiments, the inflation hose connector 430 is used to fluidly couple the inflatable bladder 120 with an inflation hose (e.g., inflation hose 130 in FIG. 1A) to allow for fluid to inflate the inflatable bladder 120 from a first position to a second position, where the difference between the first position and the second position can be seen in the change in Angle A.

FIGS. 6C.1-6C.2 illustrate embodiments of a first substantially planar structure 111 and a second substantially planar structure 112 of the frame. In some embodiments, the first substantially planar structure 111 and the second substantially planar structure 112 may be solid pieces of plastic, metal, wood, or another similar material (e.g., see FIG. 6C.1). In some embodiments, the first substantially planar structure 111 and the second substantially planar structure 112 may be perforated (e.g., see FIG. 6C.2). In some embodiments, such perforations may be used as attachment or fixture points (e.g., stopper block structure 560 in FIG. 5B). In some embodiments, such perforations may be used to reduce the overall weight of the first substantially planar structure 111 and the second substantially planar structure 112. In some embodiments, the first substantially planar structure 111 and the second substantially planar structure 112 may be different from each other, in that one may be solid while the other is perforated.

Figure 6D:
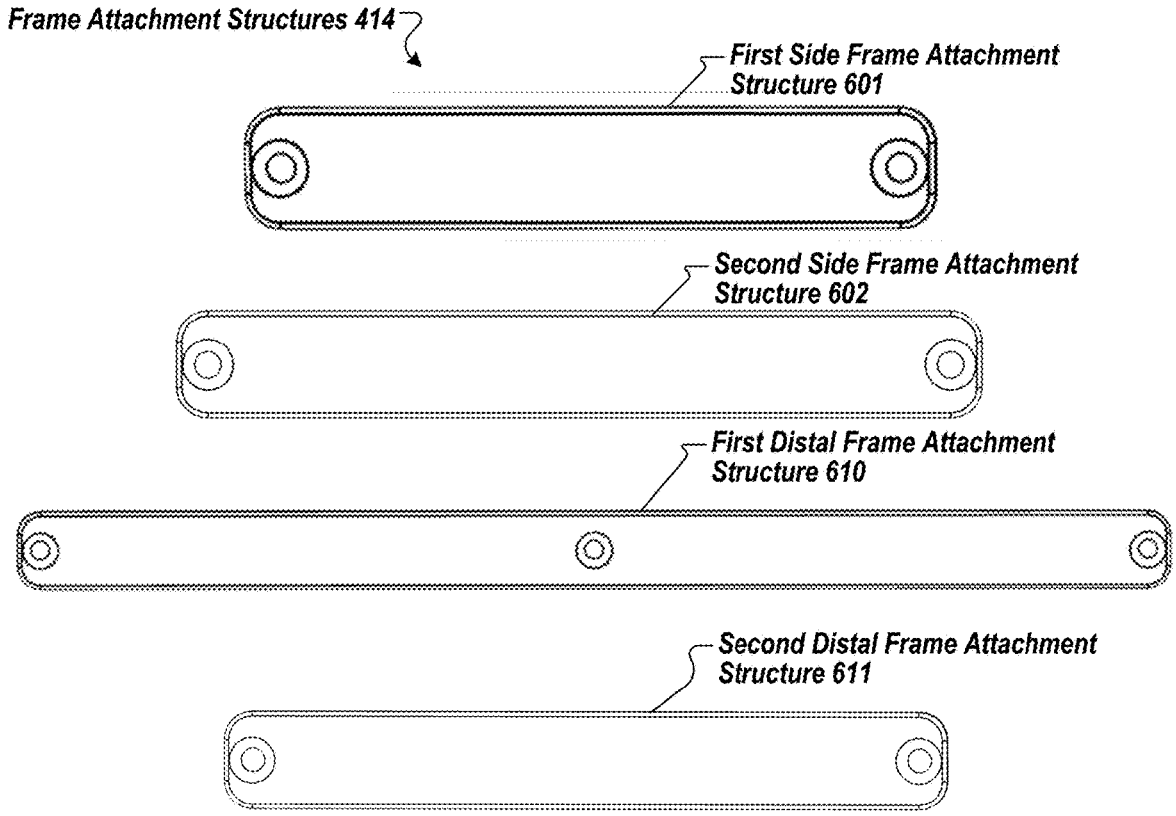
FIGS. 6A.1-E illustrate components of support devices, according to certain embodiments.
Figure 6E:
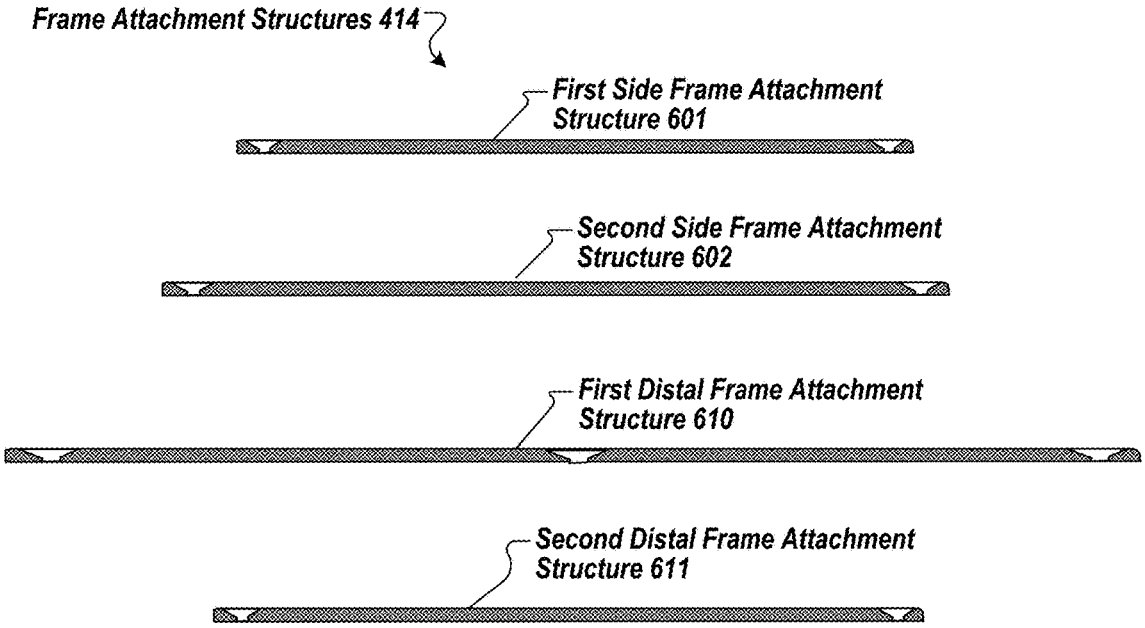

FIGS. 6D-E illustrate frame attachment structures 414, according to certain embodiments. FIG. 6D illustrates top views of frame attachment structures 414 and FIG. 6E illustrates cross-sectional views of frame attachment structures 414. In some embodiments, a variety of sizes of frame attachment structures is used. In some embodiments, a first side frame attachment structure 601 may be affixed along the surface of a first substantially planar structure (e.g., first substantially planar structure 111 in FIG. 1A) tangential to a hinge structure (e.g., hinge structure 200 in FIG. 2A). In some embodiments, a second side frame attachment structure 602 may be affixed along the surface of a second substantially planar structure (e.g., second substantially planar structure 112 in FIG. 1A) tangential to a hinge structure (e.g., hinge structure 200 in FIG. 2A). In some embodiments, the first side frame attachment structure 601 and the second side frame attachment structure 602 have complimentary lengths, such that when the first substantially planar structure is proximate the second substantially planar structure, the first side frame attachment structure 601 and the second side frame attachment structure 602 do not overlap.

In some embodiments, a first distal frame attachment structure 610 may be affixed along the surface of a first substantially planar structure (e.g., first substantially planar structure 111 in FIG. 1A) distal to a hinge structure (e.g., hinge structure 200 in FIG. 2A). In some embodiments, a second distal frame attachment structure 611 may be affixed along the surface of a second substantially planar structure (e.g., second substantially planar structure 112 in FIG. 1A) distal to a hinge structure (e.g., hinge structure 200 in FIG. 2A). In some embodiments, the first distal frame attachment structure 610 and the second distal frame attachment structure 611 have complimentary lengths, such that when the first substantially planar structure is proximate the second substantially planar structure, the first distal frame attachment structure 610 and the second distal frame attachment structure 611 do not overlap.

FIGS. 7A.1-C illustrate wedge structures 530 of support devices, according to certain embodiments.

FIGS. 7A.1-7A.2 illustrate a wedge structure 530 that is in a flexed position, such as when the inflatable bladder is inflated to cause the first substantially planar structure to be inclined. FIG. 7A.1 is a side view of the wedge structure 530 and FIG. 7A.2 is a perspective view of the wedge structure 530. A substantially pointed distal end 702 of the wedge structure 530 may remain substantially stationary while a second distal end 701 of the wedge structure 530 flexes and moves with the first substantially planar structure. Exemplary dimensions of the wedge structure are shown. In some embodiments, the wedge structure is made of thermoplastic polyurethane (TPU). In some embodiments, the hinge structure (e.g., hinge structure 200 from FIG. 2A) may be disposed within the recess created by a substantially concave sidewall 703.

FIGS. 7B.1-7B.2 illustrate the wedge structure that is in a relaxed position, such as when the inflatable bladder is deflated to cause the first substantially planar structure to be declined (e.g., in a substantially horizontal position). FIG. 7B.1 is a side view of the wedge structure 530 and FIG. 7B.2 is a perspective view of the wedge structure 530.

FIG. 7C illustrates an exemplary Length L of the wedge structure. In some embodiments, the wedge structure is the same length as the hinge structure (e.g., hinge structure 200 in FIG. 2A), first substantially planar structure (e.g., first substantially planar structure 111 in FIG. 1A), and second substantially planar structure (e.g., second substantially planar structure 112 in FIG. 1A).

Figures 8A, 8B:
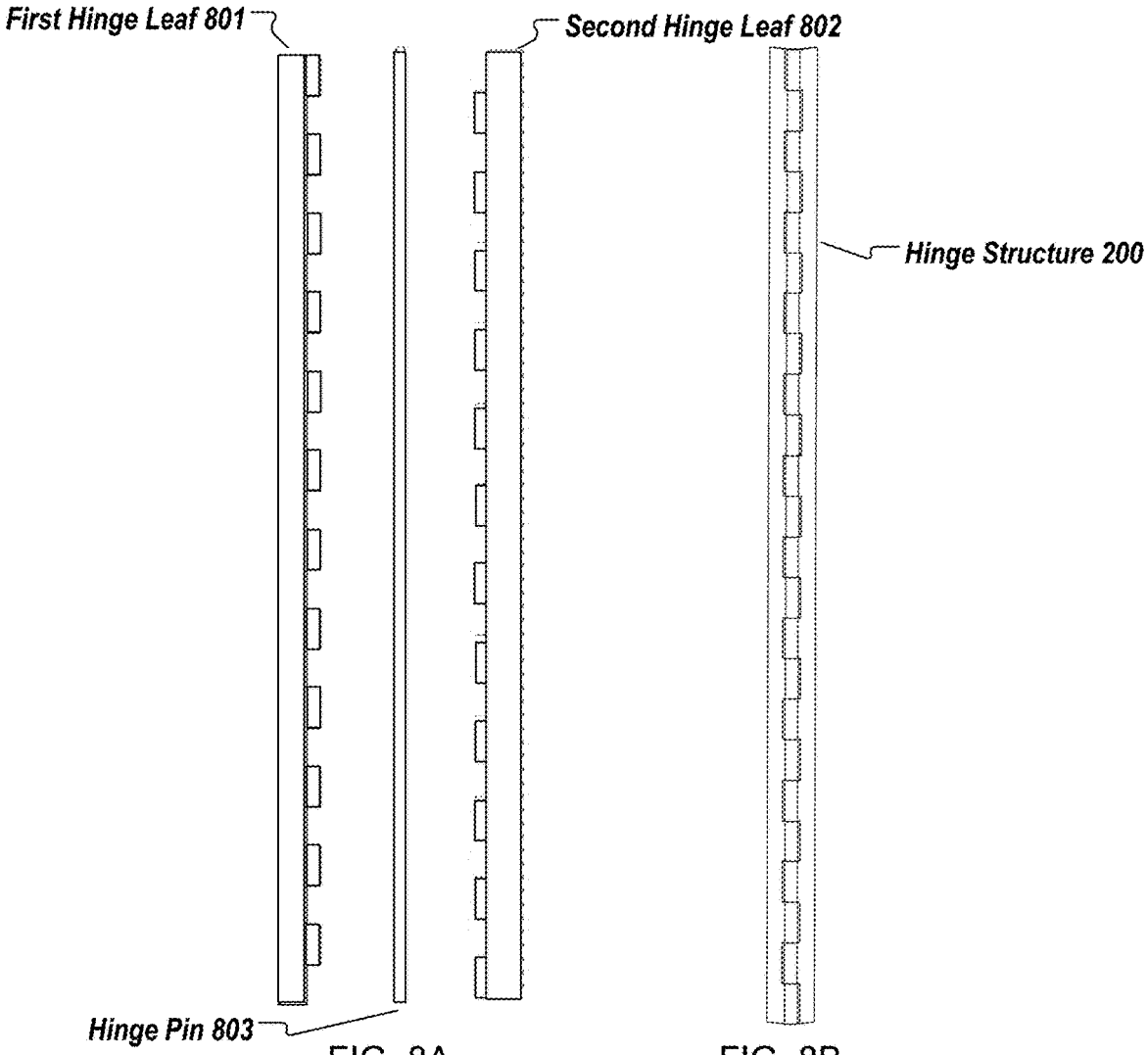
FIGS. 8A-C illustrate hinge structures of support devices, according to certain embodiments.
Figure 8C:
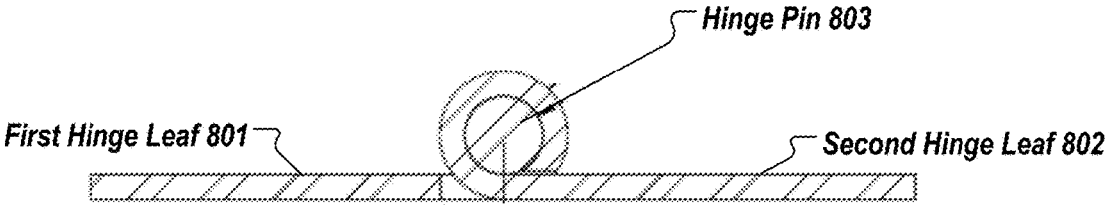

FIG. 8A-C illustrates a hinge structure 200 of adjustable support device 100, according to certain embodiments. As illustrated in this embodiment, the hinge structure 200 may be a piano hinge that has a length similar to that of a first substantially planar structure (e.g., first substantially planar structure 111 in FIG. 1A) and a second substantially planar structure (e.g., second substantially planar structure 112 in FIG. 1A).

FIG. 8A illustrates various components of a piano hinge that may be used as the hinge structure 200. In some embodiments, the hinge structure 200 may include a first hinge leaf 801, a second hinge leaf 802, and a hinge pin 803.

FIG. 8B illustrates an embodiment (e.g., an assembled view) of the hinge structure 200, wherein the first hinge leaf 801, the second hinge leaf 802, and the hinge pin 803 are combined to form the hinge structure 200.

FIG. 8C shows a cross-sectional side view of the hinge structure 200, wherein the first hinge leaf 801, the second hinge leaf 802, and the hinge pin 803 are combined to form the hinge structure 200.

In some embodiments, the terms "first," "second," "third," "fourth," etc. as used herein are meant as labels to distinguish among different elements and do not have an ordinal meaning according to their numerical designation.

Examples described herein also relate to an apparatus for performing the methods described herein. In some embodiments, this apparatus is specially constructed for performing the methods described herein, or includes a general purpose computer system selectively programmed by a computer program stored in the computer system. Such a computer program is stored in a computer-readable tangible storage medium.

The above description is intended to be illustrative, and not restrictive. Although the present disclosure has been described with references to specific illustrative examples and implementations, it will be recognized that the present disclosure is not limited to the examples and implementations described. The scope of the disclosure should be determined with reference to the following claims, along with the full scope of equivalents to which the claims are entitled.

The preceding description sets forth numerous specific details such as examples of specific systems, components, methods, and so forth in order to provide a good understanding of several embodiments of the present disclosure. It will be apparent to one skilled in the art, however, that at least some embodiments of the present disclosure may be practiced without these specific details. In other instances, well-known components or methods are not described in detail or are presented in simple block diagram format in order to avoid unnecessarily obscuring the present disclosure. Thus, the specific details set forth are merely exemplary. Particular implementations may vary from these exemplary details and still be contemplated to be within the scope of the present disclosure.

The terms "over," "under," "between," "disposed on," and "on" as used herein refer to a relative position of one material layer or component with respect to other layers or components. For example, one layer disposed on, over, or under another layer may be directly in contact with the other layer or may have one or more intervening layers. Moreover, one layer disposed between two layers may be directly in contact with the two layers or may have one or more intervening layers. Similarly, unless explicitly stated otherwise, one feature disposed between two features may be in direct contact with the adjacent features or may have one or more intervening layers.

The words "example" or "exemplary" are used herein to mean serving as an example, instance, or illustration. Any aspect or design described herein as "example" or "exemplary" is not necessarily to be construed as preferred or advantageous over other aspects or designs. Rather, use of the words "example" or "exemplary" is intended to present concepts in a concrete fashion.

Reference throughout this specification to "one embodiment," "an embodiment," or "some embodiments" means that a particular feature, structure, or characteristic described in connection with the embodiment is included in at least one embodiment. Thus, the appearances of the phrase "in one embodiment," "in an embodiment," or "in some embodiments" in various places throughout this specification are not necessarily all referring to the same embodiment. In addition, the term "or" is intended to mean an inclusive "or" rather than an exclusive "or." That is, unless specified otherwise, or clear from context, "X includes A or B" is intended to mean any of the natural inclusive permutations. That is, if X includes A, X includes B, or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Also, the terms "first," "second," "third," "fourth," etc. as used herein are meant as labels to distinguish among different elements and can not necessarily have an ordinal meaning according to their numerical designation. When the term "about," "substantially," or "approximately" is used herein, this is intended to mean that the nominal value presented is precise within ±10%.

It is understood that the above description is intended to be illustrative, and not restrictive. Many other embodiments will be apparent to those of skill in the art upon reaching and understanding the above description. The scope of the disclosure should, therefore, be determined with reference to the appended claims, along with the full scope of equivalents to which such claims are entitles.

What is claimed is:

1. A support device comprising:

a frame comprising:

a first substantially planar structure; and a second substantially planar structure rotatably coupled to the first substantially planar structure;

an inflatable bladder comprising:

a plurality of walls forming an interior volume; and a first bladder attachment structure comprising a first edge attached to a first wall of the plurality of walls, wherein the first bladder attachment structure forms a first channel that is substantially parallel to the first edge; and a first frame attachment structure configured to be routed through the first channel formed by the first bladder attachment structure and removably fastened to the frame to secure the inflatable bladder to the frame without the first frame attachment structure contacting the plurality of walls.

2. The support device of claim 1, wherein the inflatable bladder is configured to be inflated from a first position to a second position disposed between the first substantially planar structure and the second substantially planar structure.

3. The support device of claim 1 further comprising a second frame attachment structure, wherein:

the first frame attachment structure is configured to be removably attached to the first substantially planar structure to secure the inflatable bladder to the first substantially planar structure;

the second frame attachment structure is configured to be removably attached to the second substantially planar structure; and the second frame attachment structure is configured to be routed through a second channel formed by a second bladder attachment structure to secure the inflatable bladder to the second substantially planar structure.

4. The support device of claim 1, wherein responsive to the first frame attachment structure being routed through the first bladder attachment structure, a first distal end of the first frame attachment structure is to be attached to the frame, a second distal end of the first frame attachment structure is to be attached to the frame, and the first bladder attachment structure is disposed around a central portion of the first frame attachment structure, the central portion being disposed between the first distal end and the second distal end.

5. The support device of claim 1 further comprising a second bladder attachment structure, wherein the first bladder attachment structure is configured to be attached to the first substantially planar structure, and wherein the second bladder attachment structure is configured to be attached to the second substantially planar structure.

6. The support device of claim 5, wherein the first frame attachment structure has a first length of about 3 inches to about 12 inches.

7. The support device of claim 5, wherein the first bladder attachment structure and the second bladder attachment structure are disposed along one or more edges of at least one of the plurality of walls and are configured to be proximate the frame.

8. The support device of claim 1, wherein the first substantially planar structure and the second substantially planar structure are perforated.

9. The support device of claim 1, wherein the first substantially planar structure and the second substantially planar structure are rotatably coupled via a hinge structure.

10. A collapsible support device comprising:

a frame comprising a first substantially planar structure and a second substantially planar structure that are rotatably coupled via a hinge structure;

an inflatable bladder comprising a first surface configured to be coupled to the first substantially planar structure and a second surface configured to be coupled to the second substantially planar structure, wherein the inflatable bladder is configured to be inflated from a first position to a second position disposed between the first substantially planar structure and the second substantially planar structure; and a plurality of stopper block structures attached to the frame, wherein each of the plurality of stopper block structures has a substantially cylindrical shape, and wherein the plurality of stopper block structures contact the first substantially planar structure and the second substantially planar structure responsive to the inflatable bladder being in the first position.

11. The collapsible support device of claim 10, wherein each of the plurality of stopper block structures has a corresponding height that is at least same as a substantially deflated height of the inflatable bladder in the first position.

12. The collapsible support device of claim 10 further comprising an inflation hose configured to be coupled to the inflatable bladder, wherein fluid is to be provided via the inflation hose to inflate the inflatable bladder.

13. The collapsible support device of claim 12, wherein each of the plurality of stopper block structures has a corresponding height that is at least same as an outer diameter of the inflation hose, and wherein each of the plurality of stopper block structures has an outer surface that is tapered towards the frame.

14. The collapsible support device of claim 12 further comprising an inflation hose clip coupled to the frame at a first location that is different than a second location of the inflatable bladder, and wherein the inflation hose clip is configured to secure the inflation hose to the frame.

15. The collapsible support device of claim 12, wherein the inflation hose is fluidly coupled between the inflatable bladder and an inflation device, wherein the inflation device is configured to adjust an internal pressure of the inflatable bladder to adjust inflation of the inflatable bladder between the first position and the second position.

16. An adjustable support device comprising:

a frame comprising a first substantially planar structure and a second substantially planar structure that are rotatably coupled via a hinge structure;

a wedge structure attached to the frame proximate the hinge structure, wherein the wedge structure is configured to move with the first substantially planar structure responsive to an inflatable bladder inflating from a first position to a second position; and the inflatable bladder comprising a first surface configured to be coupled to the first substantially planar structure and a second surface configured to be coupled to the second substantially planar structure, wherein the inflatable bladder is configured to be inflated from the first position to the second position between the first and the second substantially planar structures, the inflatable bladder being a different component than the wedge structure.

17. The adjustable support device of claim 16, wherein the wedge structure comprises a substantially pointed distal end, a second distal end, and a substantially concave sidewall disposed between the substantially pointed distal end and the second distal end.

18. The adjustable support device of claim 17, wherein the hinge structure is disposed proximate the substantially concave sidewall.

19. The adjustable support device of claim 17, wherein the second distal end of the wedge structure is configured to be attached to the first substantially planar structure or the second substantially planar structure.

20. The adjustable support device of claim 17, wherein the second distal end is flexible to cause the wedge structure to remain substantially stationary relative to at least one of the first substantially planar structure or the second substantially planar structure during inflation of the inflatable bladder from the first position to the second position.

* * * * *